US012607072B2

(12) United States Patent
Chen

(10) Patent No.: US 12,607,072 B2
(45) Date of Patent: Apr. 21, 2026

(54) MULTI-LAYER DRILL BIT APPARATUS AND SYSTEMS

(71) Applicant: Halliburton Energy Services, Inc., Houston, TX (US)

(72) Inventor: Shilin Chen, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/812,429

(22) Filed: Aug. 22, 2024

(65) Prior Publication Data

US 2024/0410231 A1 Dec. 12, 2024

Related U.S. Application Data

(63) Continuation of application No. 17/286,979, filed as application No. PCT/US2018/065482 on Dec. 13, 2018, now abandoned.

(51) Int. Cl.
*E21B 10/43* (2006.01)
*E21B 10/633* (2006.01)

(52) U.S. Cl.
CPC ..... *E21B 10/43* (2013.01); *E21B 10/633* (2013.01)

(58) Field of Classification Search
CPC ..... E21B 10/43; E21B 10/62; E21B 10/627; E21B 10/633; E21B 10/006; E21B 10/54
See application file for complete search history.

(56) References Cited

U.S. PATENT DOCUMENTS

| | | | | |
|---|---|---|---|---|
| 5,238,075 | A | 8/1993 | Keith et al. | |
| 5,531,281 | A | 7/1996 | Murdock | |
| 5,549,171 | A | 8/1996 | Mensa-Wilmot et al. | |
| 10,399,206 | B1 * | 9/2019 | Mortensen | C22C 1/04 |
| 2007/0261890 | A1 | 11/2007 | Cisneros | |
| 2008/0179108 | A1 | 7/2008 | Mcclain et al. | |
| 2008/0302575 | A1 | 12/2008 | Durairajan et al. | |
| 2009/0266619 | A1 | 10/2009 | Durairajan et al. | |
| 2010/0000800 | A1 * | 1/2010 | Chen | E21B 10/567 175/428 |

(Continued)

OTHER PUBLICATIONS

"International Search Report for PCT Patent Application No. PCT/US2018/065482", 3.

(Continued)

*Primary Examiner* — Blake Michener
(74) *Attorney, Agent, or Firm* — DeLizio, Peacock, Lewin & Guerra LLP

(57) ABSTRACT

A downhole drilling system comprises a drill string and a drill bit coupled to the drill string. The drill bit comprises a bit body with primary and secondary blades disposed thereon. Some of the secondary blades are alternately disposed between some of the primary blades. Two first layer cutting elements are disposed on different ones of the primary blades, and substantially diametrically opposed to each other along a first track set radius of the bit body, while two second layer cutting elements are disposed on different ones of the secondary blades, and substantially diametrically opposed to each other along the first track set radius. The second layer cutting elements are sized to provide a selected amount of underexposure greater than zero with respect to the first layer cutting elements.

19 Claims, 24 Drawing Sheets

(56) References Cited

U.S. PATENT DOCUMENTS

| | | | | |
|---|---|---|---|---|
| 2011/0100714 | A1* | 5/2011 | Moss | E21B 10/26 175/57 |
| 2011/0315448 | A1 | 12/2011 | Stowe, II et al. | |
| 2015/0000988 | A1 | 1/2015 | Chen | |
| 2015/0122551 | A1 | 5/2015 | Chen | |
| 2015/0152689 | A1 | 6/2015 | Chen et al. | |
| 2015/0300095 | A1 | 10/2015 | Chen | |
| 2016/0281437 | A1* | 9/2016 | Chen | E21B 7/046 |
| 2016/0376846 | A1 | 12/2016 | Chen | |
| 2017/0284161 | A1 | 10/2017 | Zhang | |
| 2021/0388678 | A1 | 12/2021 | Chen | |

OTHER PUBLICATIONS

"International Written Opinion for PCT Patent Application No. PCT/US2018/065482", 4.
"U.S. Appl. No. 17/286,979, Final Office Action", Oct. 4, 2023, 13 pages.
"U.S. Appl. No. 17/286,979, Final Office Action", Nov. 17, 2022, 12 pages.
"U.S. Appl. No. 17/286,979, Non-Final Office Action", Dec. 6, 2023, 13 pages.
"U.S. Appl. No. 17/286,979, Non-Final Office Action", May 26, 2022, 12 pages.
"U.S. Appl. No. 17/286,979, Non-Final Office Action", Jul. 19, 2023, 11 pages.
"U.S. Appl. No. 17/286,979 Final Office Action", Jun. 26, 2024, 15 pages.

* cited by examiner

MULTI-LAYER DRILL BIT APPARATUS AND SYSTEMS

TECHNICAL FIELD

The present disclosure relates generally to downhole drilling tools and, more particularly, to rotary drill bits with multi-layer cutting elements.

BACKGROUND

Various types of downhole drilling tools include, but not limited to, rotary drill bits. Downhole drilling tools may be used in formations that have a relatively low compressive strength in the upper formation portions (e.g., lesser drilling depths), and a relatively high compressive strength in the lower formation portions (e.g., greater drilling depths). Thus, drilling downhole may become increasingly difficult as the formation compressive strength increases with depth, along with increased cutting element wear.

BRIEF DESCRIPTION OF THE DRAWINGS

A more complete understanding of the present disclosure and its features and advantages thereof may be acquired by referring to the following description, taken in conjunction with the accompanying drawings, in which like reference numbers indicate like features, and wherein.

DETAILED DESCRIPTION

The present disclosure relates to rotary drill bits in which cutting elements are arranged in multiple layers on blades of the drill bit such that back-up (second) layer cutting elements engage formations when primary (first) layer cutting elements are sufficiently worn. The second layer cutting elements can be greater in size than the first layer cutting elements. The first and the second layer cutting elements can have the same shape as well.

Embodiments of the present disclosure and its advantages are best understood by referring to FIGS. 1-10, where like numbers are used to indicate like and corresponding parts.

Figure 1:
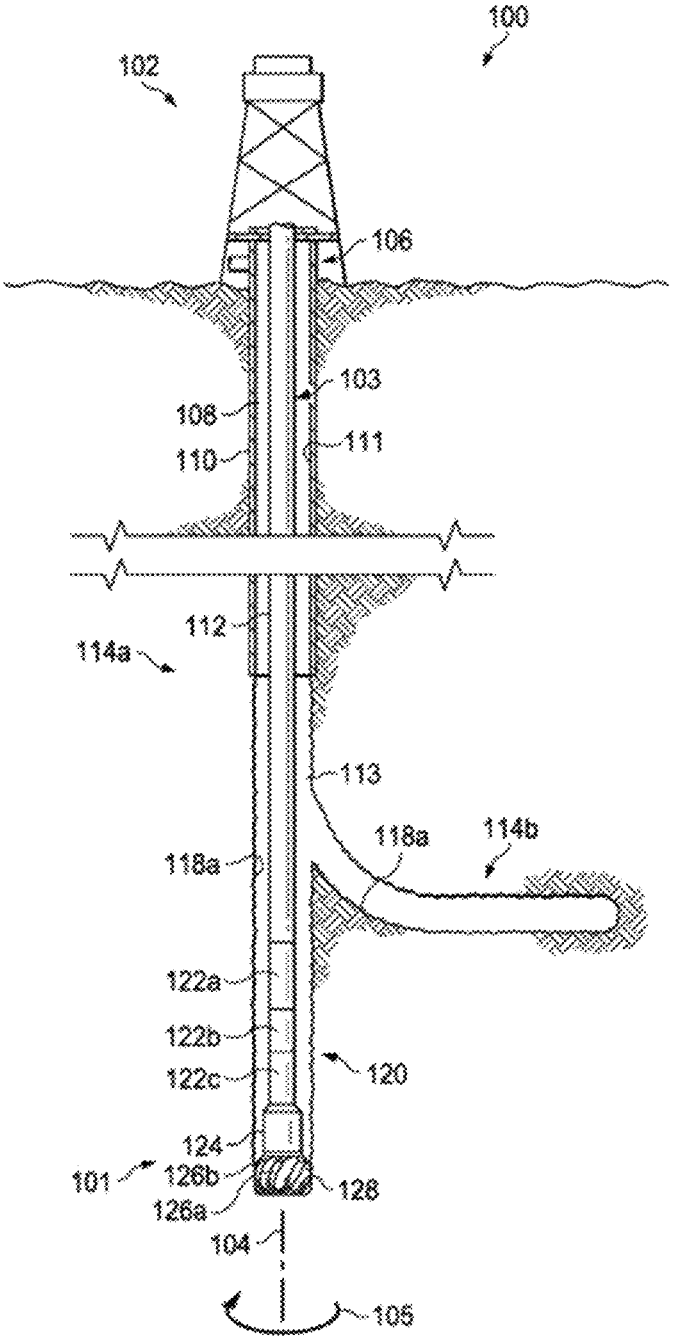
FIG. 1 is an elevation view of a drilling system in which a rotary drill bit may be used.

FIG. 1 is an elevation view of an example drilling system 100. Drilling system 100 is configured to drill boreholes 118*a* into one or more geological formations. Drilling system 100 may include well surface or well site 106. Various types of drilling equipment such as a rotary table, mud pumps and mud tanks (not expressly shown) may be located at a well surface sometimes referred to as "well site" 106. For example, well site 106 may include drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

Drilling system 100 may include drill string 103 associated with rotary drill bit 101 that may be used to rotate rotary drill bit 101 in radial direction 105 around bit rotational axis 104 of form a wide variety of wellbores 114 such as generally vertical wellbore 114*a* or generally horizontal wellbore 114*b* as shown in FIG. 1. Various directional drilling techniques and associated components of bottom hole assembly (BHA) 120 of drill string 103 may be used to form generally horizontal wellbore 114*b*. For example, lateral forces may be applied to drill bit 101 proximate kickoff location 113 to form generally horizontal wellbore 114*b* extending from generally vertical wellbore 114*a*. Wellbore 114 is drilled to a drilling distance, which is the distance between the well surface and the furthest extent of wellbore 114, and which increases as drilling progresses.

BHA 120 may be formed from a wide variety of components configured to form a wellbore 114. For example, components 122*a*, 1226 and 122*c* of BHA 120 may include, but are not limited to rotary drill bit 101, drill collars, rotary steering tools, directional drilling tools, downhole drilling motors, reamers, hole enlargers or stabilizers. The number of components such as drill collars and different types of components 122 included in BHA 120 may depend upon anticipated downhole drilling conditions and the type of wellbore that will be formed by drill string 103 and fixed-cutter drill bit 101.

Wellbore 114 may be defined in part by casing string 110 that may extend from well site 106 to a selected downhole location. Various types of drilling fluid may be pumped from well site 106 through drill string 103 to attached drill bit 101. Such drilling fluids may be directed to flow from drill string 103 to respective nozzles included in rotary drill bit 101. The drilling fluid may be circulated back to well surface 106 through annulus 108 defined in part by outside diameter 112 of drill string 103 and inside diameter 111 of casing string 110.

Drilling system 100 may also include rotary drill bit ("drill bit") 101. Drill bit 101, discussed in further detail in FIG. 2, may include one or more blades 126 that may be disposed outwardly from exterior portions of rotary bit body 124 of drill bit 101. Rotary bit body 124 may have a generally cylindrical body and blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126.

Blades 126 may include one or more depth of cut controllers (not expressly shown) configured to control the depth of cut of cutting elements 128. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

Drilling system 100 may include one or more second layer cutting elements on a drill bit that are configured to cut into the geological formation at particular drilling depths and/or when first layer cutting elements experience sufficient wear. Thus, multiple layers of cutting elements may exist that engage with the formation at multiple drilling depths. Placement and configuration of the first layer and second layer cutting elements on blades of a drill bit may be varied to enable the different layers to engage at specific drilling depths. For example, configuration considerations may include under-exposure and blade placement of second layer cutting elements with respect to first layer cutting elements, and/or characteristics of the formation to be drilled.

Cutting elements may be arranged in multiple layers on blades such that second layer cutting elements may engage the formation when the depth of cut is greater than a specified value and/or when first layer cutting elements are sufficiently worn. In some embodiments, the drilling tools may have first layer cutting elements arranged on blades in a single-set or a track-set configuration. Second layer cutting elements may be arranged on different blades that are track-set and under-exposed with respect to the first layer cutting elements. In some embodiments, the amount of under-exposure may be approximately the same for each of the second layer cutting elements. In other embodiments, the amount of under-exposure may vary for each of the second layer cutting elements.

Figure 2:
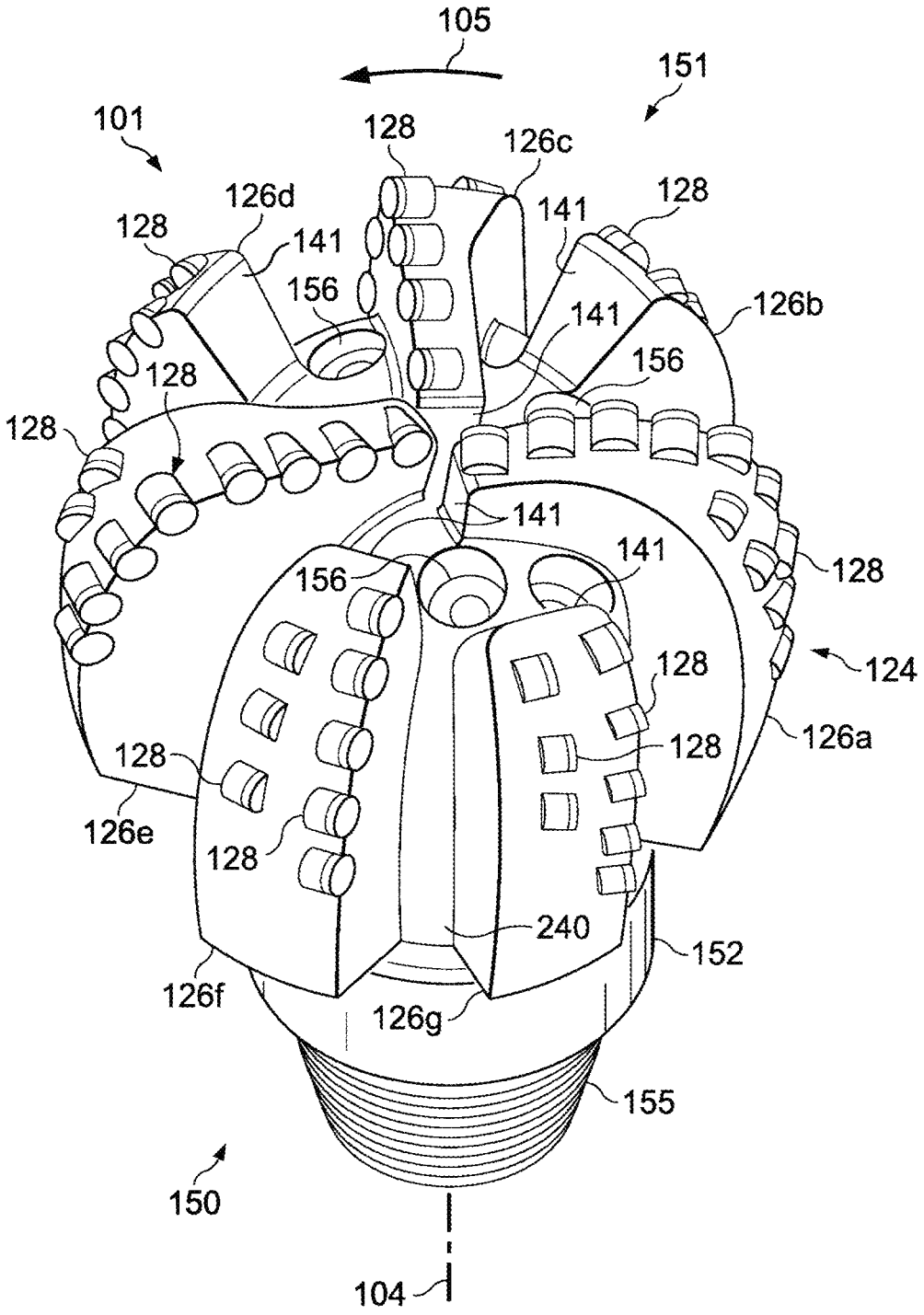
FIG. 2 is an isometric view of a rotary drill bit oriented upwardly in a manner often used to model or design fixed cutter drill bits.

FIG. 2 illustrates an isometric view of rotary drill bit 101 oriented upwardly in a manner often used to model or design fixed cutter drill bits, in accordance with some embodiments of the present disclosure. Drill bit 101 may be any of various types of fixed cutter drill bits, including Polycrystalline Diamond Compact (PDC) bits, drag bits, matrix drill bits, and/or steel body drill bits operable to form wellbore 114 extending through one or more downhole formations. Drill bit 101 may be designed and formed in accordance with teachings of the present disclosure and may have many different designs, configurations, and/or dimensions according to the particular application of drill bit 101.

Drill bit 101 may include one or more blades 126 (e.g., blades 126*a*-126*g*) that may be disposed outwardly from exterior portions of rotary bit body 124 of drill bit 101. Rotary bit body 124 may have a generally cylindrical body and blades 126 may be any suitable type of projections extending outwardly from rotary bit body 124. For example, a portion of blade 126 may be directly or indirectly coupled to an exterior portion of bit body 124, while another portion of blade 126 is projected away from the exterior portion of bit body 124. Blades 126 formed in accordance with teachings of the present disclosure may have a wide variety of configurations including, but not limited to, substantially arched, helical, spiraling, tapered, converging, diverging, symmetrical, and/or asymmetrical.

In some cases, blades 126 may have substantially arched configurations, generally helical configurations, spiral shaped configurations, or any other configuration satisfactory for use with each downhole drilling tool. One or more blades 126 may have a substantially arched configuration extending from proximate rotational axis 104 of drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit.

Each of blades 126 may include a first end disposed proximate or toward bit rotational axis 104 and a second end disposed proximate or toward exterior portions of drill bit 101 (e.g., disposed generally away from bit rotational axis 104 and toward uphole portions of drill bit 101). The terms "uphole" and "downhole" may be used to describe the location of various components of drilling system 100 relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Blades 126*a*-126*g* may include primary blades disposed about the bit rotational axis. For example, in FIG. 2, blades 126*a*, 126*c*, and 126*e* may be primary blades or major blades because respective first ends 141 of each of blades 126*a*, 126*c*, and 126*e* may be disposed closely adjacent to associated bit rotational axis 104. In some embodiments, blades 126*a*-126*g* may also include at least one secondary blade disposed between the primary blades. Blades 126*b*, 126*d*, 126*f*, and 126*g* shown in FIG. 2 on drill bit 101 may be secondary blades or minor blades because respective first ends 141 may be disposed on downhole end 151 a distance from associated bit rotational axis 104. The number and location of secondary blades and primary blades may vary such that drill bit 101 includes more or less secondary and primary blades. Blades 126 may be disposed symmetrically or asymmetrically with regard to each other and bit rotational axis 104 where the disposition may be based on the downhole drilling conditions of the drilling environment. In some cases, blades 126 and drill bit 101 may rotate about rotational axis 104 in a direction defined by directional arrow 105.

Each blade may have a leading (or front) surface disposed on one side of the blade in the direction of rotation of drill bit 101 and a trailing (or back) surface disposed on an opposite side of the blade away from the direction of rotation of drill bit 101. Blades 126 may be positioned along bit body 124 such that they have a spiral configuration relative to rotational axis 104. In other embodiments, blades 126 may be positioned along bit body 124 in a generally parallel configuration with respect to each other and bit rotational axis 104.

Blades 126 may include one or more cutting elements 128 disposed outwardly from exterior portions of each blade 126. For example, a portion of cutting element 128 may be directly or indirectly coupled to an exterior portion of blade 126 while another portion of cutting element 128 may be projected away from the exterior portion of blade 126. Cutting elements 128 may be any suitable device configured to cut into a formation, including but not limited to, primary cutting elements, back-up cutting elements, secondary cutting elements or any combination thereof. By way of example and not limitation, cutting elements 128 may be various types of cutters, compacts, buttons, inserts, and gage cutters satisfactory for use with a wide variety of drill bits 101.

Cutting elements 128 may include respective substrates with a layer of hard cutting material disposed on one end of each respective substrate. The hard layer of cutting elements 128 may provide a cutting surface that may engage adjacent portions of a downhole formation to form wellbore 114. The contact of the cutting surface with the formation may form a cutting zone associated with each of cutting elements 128. The edge of the cutting surface located within the cutting zone may be referred to as the cutting edge of a cutting element 128.

Each substrate of cutting elements 128 may have various configurations and may be formed from tungsten carbide or other materials associated with forming cutting elements for rotary drill bits. Tungsten carbides may include, but are not limited to, monotungsten carbide (WC), ditungsten carbide ($W_2C$), macrocrystalline tungsten carbide and cemented or sintered tungsten carbide. Substrates may also be formed using other hard materials, which may include various metal alloys and cements such as metal borides, metal carbides, metal oxides and metal nitrides. For some applications, the hard cutting layer may be formed from substantially the same materials as the substrate. In other applications, the hard cutting layer may be formed from different materials than the substrate. Examples of materials used to form hard cutting layers may include polycrystalline diamond materials, including synthetic polycrystalline diamonds.

In some embodiments, blades 126 may also include one or more depth of cut controllers (DOCCs) (not expressly shown) configured to control the depth of cut of cutting elements 128. A DOCC may comprise an impact arrestor, a back-up cutting element and/or an MDR (Modified Diamond Reinforcement). Exterior portions of blades 126, cutting elements 128 and DOCCs (not expressly shown) may form portions of the bit face.

Blades 126 may further include one or more gage pads (not expressly shown) disposed on blades 126. A gage pad may be a gage, gage segment, or gage portion disposed on exterior portion of blade 126. Gage pads may often contact adjacent portions of wellbore 114 formed by drill bit 101. Exterior portions of blades 126 and/or associated gage pads may be disposed at various angles, positive, negative, and/or parallel, relative to adjacent portions of generally vertical wellbore 114*a*. A gage pad may include one or more layers of hardfacing material.

Uphole end 150 of drill bit 101 may include shank 152 with drill pipe threads 155 formed thereon. Threads 155 may be used to releasably engage drill bit 101 with BHA 120, described in detail below, whereby drill bit 101 may be rotated relative to bit rotational axis 104. Downhole end 151 of drill bit 101 may include a plurality of blades 126*a*-126*g* with respective junk slots or fluid flow paths 240 disposed therebetween. Additionally, drilling fluids may be communicated to one or more nozzles 156.

Drill bit operation may be expressed in terms of depth of cut per revolution as a function of drilling depth. Depth of cut per revolution, or "depth of cut," may be determined by rate of penetration (ROP) and revolution per minute (RPM). ROP may represent the amount of formation that is removed as drill bit 101 rotates and may be in units of ft/hr. Further, RPM may represent the rotational speed of drill bit 101. For example, drill bit 101 utilized to drill a formation may rotate at approximately 120 RPM. Actual depth of cut (A) may represent a measure of the depth that cutting elements cut into the formation during a rotation of drill bit 101. Thus, actual depth of cut may be expressed as a function of actual ROP and RPM using the following equation:

$$\Delta = ROP/(5*RPM).$$

Actual depth of cut may have a unit of in/rev.

Multiple formations of varied formation strength may be drilled using drill bits configured in accordance with some embodiments of the present disclosure. As drilling depth increases, formation strength may likewise increase. For example, a first formation may extend from the surface to a drilling depth of approximately 3000 feet and may have a rock strength of approximately 10,000 pounds per square inch (psi). Additionally, a second formation may extend from a drilling depth of approximately 3,000 feet to a drilling depth of approximately 5,000 feet and may have rock strength of approximately 15,000 psi. As another example, a third formation may extend from a drilling depth of approximately 5,000 feet to a drilling depth of approximately 6,000 feet and may have a rock strength over approximately 20,000 psi.

With increased drilling depth, formation strength or rock strength may increase or decrease and thus, the formation may become more difficult or may become easier to drill. For example, a drill bit including seven blades may drill through the first formation very efficiently, but a drill bit including nine blades may be desired to drill through the second and third formations.

Accordingly, as drill bit 101 drills into a formation, the cutting elements 128 may begin to wear as the drilling depth increases.

Figure 3A:
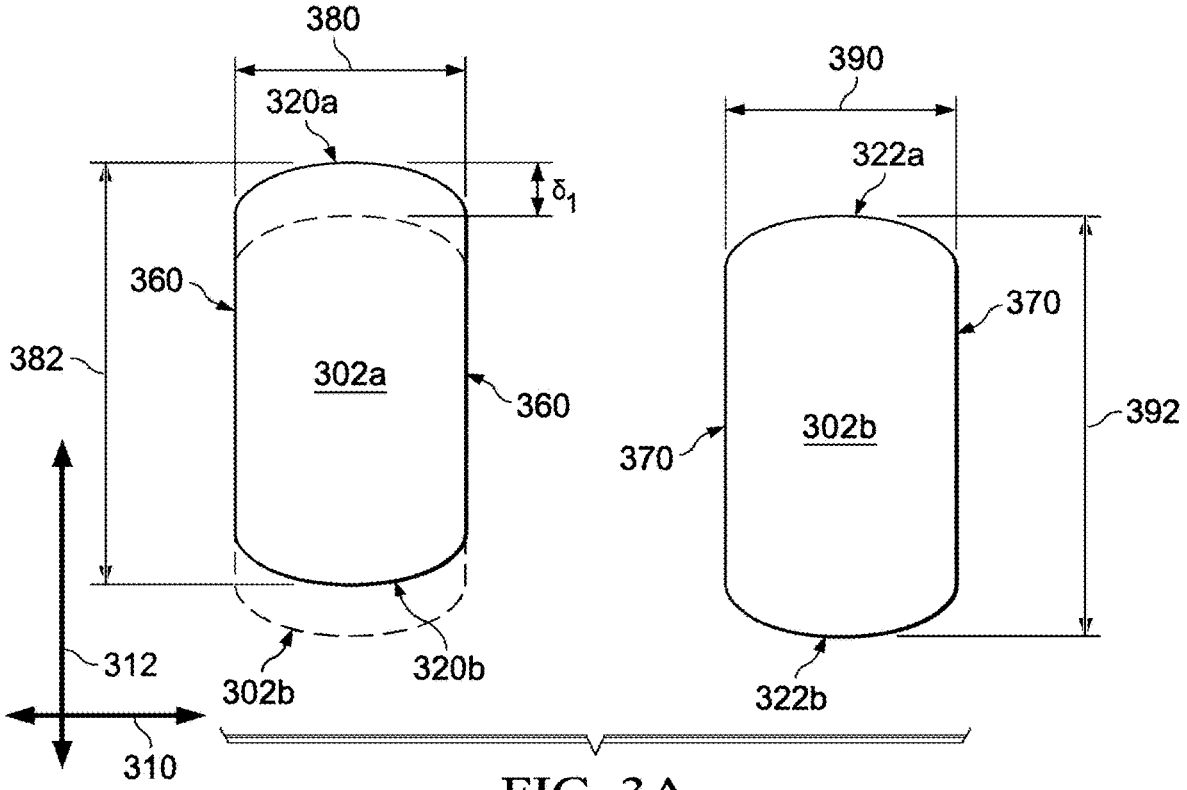
FIG. 3A is a perspective view of cutting elements of a rotary drill bit without wear.
Figure 3B:
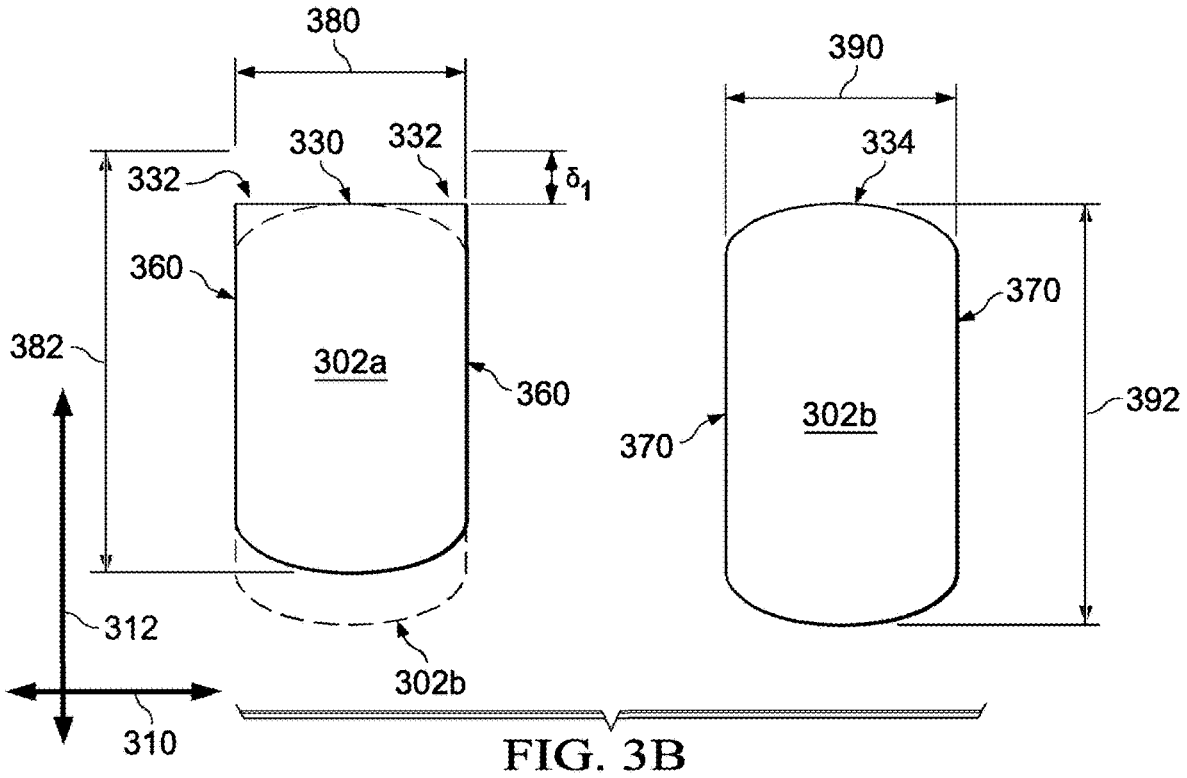
FIG. 3B is a perspective view of cutting elements of a rotary drill bit with little wear.
Figure 3C:
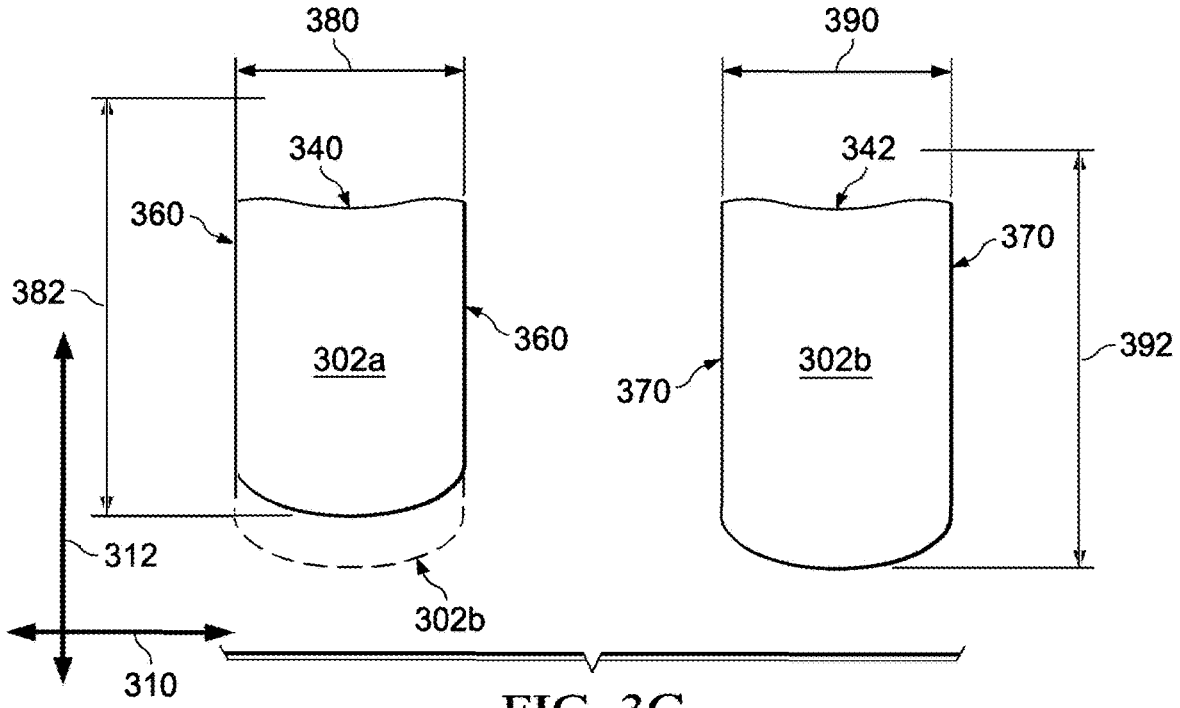
FIG. 3C is a perspective view of cutting elements of a rotary drill bit with substantial wear.

FIGS. 3A-3C illustrate a first layer cutting element 302*a* and a second layer cutting element 302*b* (collectively referred to as cutting elements 302). For simplicity of illustration, the first layer cutting element 302*a* is illustrated as overlaid with the second layer cutting element 302*b*, and the second layer cutting element 3026 illustrated separately as well. The first layer cutting element 302*a* and the second layer cutting element 302*b* can be similar to the cutting elements 128 described above with respect to FIG. 1.

FIG. 3A illustrates the cutting elements 302 prior to wear on the cutting elements 302, and specifically, prior to wear on the first layer cutting element 302*a*. The cutting elements 302 can extend along a first direction 310 and a second direction 312, with the second direction 312 being orthogonal to the first direction 310.

The first layer cutting element 302*a* can extend along the first direction 310 a distance 380 and along the second direction 312 a distance 382. In some examples, the distance 380 is less than the distance 382. In some examples, the first layer cutting element 302*a* has a rectangular geometric shape, with distal ends 320*a*, 320*b* (collectively referred to as distal ends 320) along the second direction 312 having an arc.

In some examples, the first layer cutting element 302*a* has a circular geometric shape that is truncated along the first direction 310. Specifically, the first layer cutting element 302*a* is truncated, forming substantially planar sides 360.

The second layer cutting element 3026 can extend along the first direction 310 a distance 390 and along the second direction 312 a distance 392. In some examples, the distance 390 is less than the distance 392. In some examples, the second layer cutting element 302*b* has a rectangular geometric shape, with distal ends 322*a*, 322*b* (collectively referred to as distal ends 322) along the second direction 312 having an arc. In some examples, the distance 390 is greater than or equal to the distance 380. In some examples, the distance 382 is greater than or equal to the distance 392.

In some examples, the second layer cutting element 3026 has a circular geometric shape that is truncated along the first direction 310. Specifically, the second layer cutting element 302*b* is truncated, forming substantially planar sides 370.

To that end, the second layer cutting element 3026 can be underexposed relative to the first layer cutting element 302*a*, e.g., underexposed a distance $\delta_1$. That is, the second layer cutting element 302*b* can be positioned relative to the first layer cutting element 302*a* such that the second layer cutting element 302*b* does not cut into the formations until a particular drilling depth is achieved, e.g., based on the distance $\delta_1$.

FIG. 3B illustrates the cutting elements 302 at a first level of wear. In some examples, the first level of wear can be substantially the same as the amount of underexposure of the second layer cutting element 3026 with respect to the first layer cutting element 302*a*, e.g., the distance $\delta_1$. As illustrated, the first layer cutting element 302*a*, at the first level of wear, includes a first worn edge 330 that includes (non-efficient) cutting zones 332. Additionally, the second layer cutting element 3026 includes a first cutting edge 334. In some examples, the first layer cutting element 302*a* can serve as the major cutter, while the second layer cutting element 302*b* can begin to serve as an active cutter.

FIG. 3C illustrates the cutting elements 302 at a second level of wear. In some examples, the second level of wear is greater than the amount of underexposure of the second layer cutting element 3026 with respect to the first layer cutting element 302*a*, e.g., the distance $\delta_1$. As illustrated, the first layer cutting element 302, at the second level of wear, includes a second worn edge 340. Additionally, the second layer cutting element 302*b* includes a second cutting edge 342. In some examples, the second worn edge 340 of the first layer cutting element 302*a* and the second cutting edge 342 of the second layer cutting element 3026 are at a substantially same radially position from a center of the drill bit 101. In some examples, the first layer cutting element 302*a* and the second layer cutting element 3026 can both serve as major cutters.

Figure 4A:
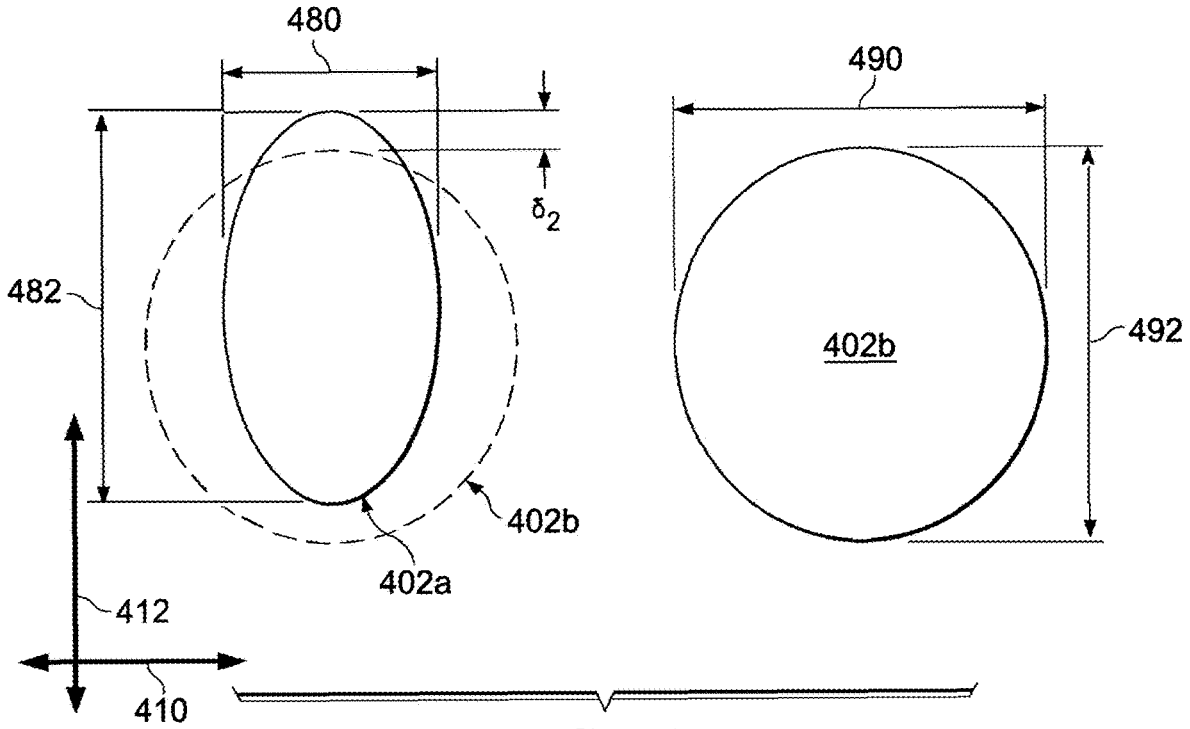
FIG. 4A is a perspective view of cutting elements of a rotary drill bit without wear.
Figure 4B:
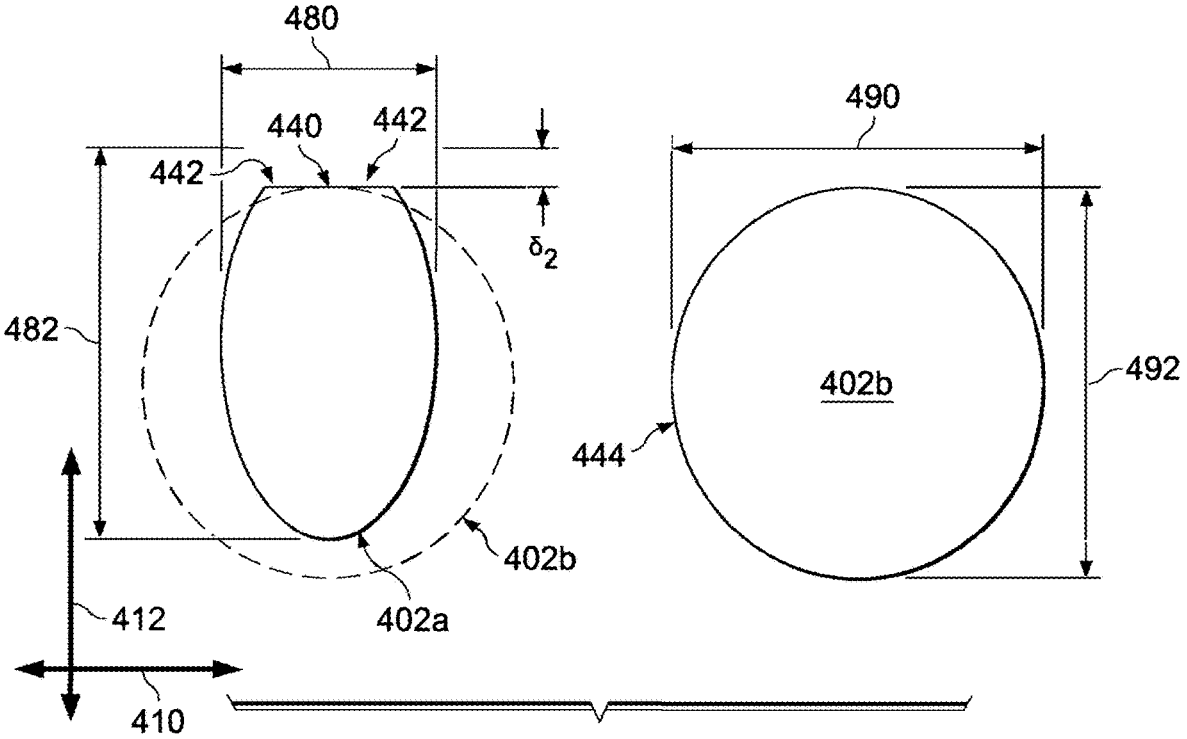
FIG. 4B is a perspective view of cutting elements of a rotary drill bit with little wear.
Figure 4C:
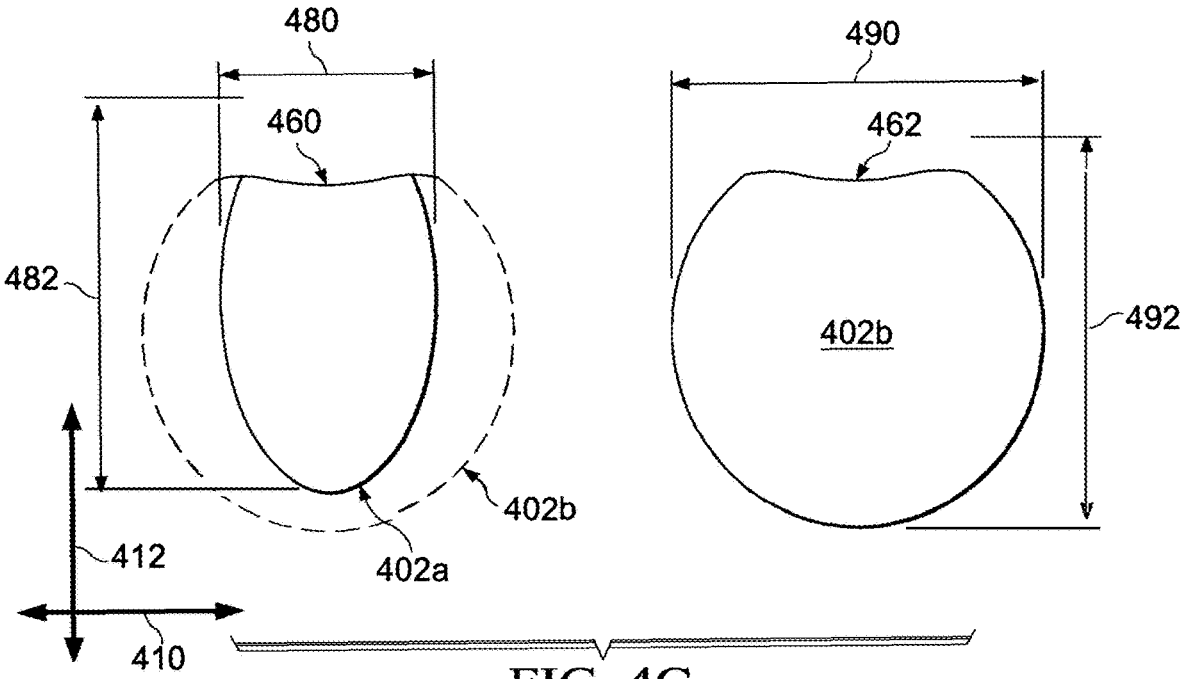
FIG. 4C is a perspective view of cutting elements of a rotary drill bit with substantial wear.

FIGS. 4A-4C illustrate a first layer cutting element 402*a* and a second layer cutting element 402*b* (collectively referred to as cutting elements 402). For simplicity of illustration, the first layer cutting element 402*a* is illustrated as overlaid with the second layer cutting element 402*b*, and the second layer cutting element 4026 illustrated separately as well. The first layer cutting element 402*a* and the second layer cutting element 402*b* can be similar to the cutting elements 128 described above with respect to FIG. 1.

FIG. 4A illustrates the cutting elements 402 prior to wear on the cutting elements 402, and specifically, wear on the first layer cutting element 402*a*. The cutting elements 402 can extend along a first direction 410 and a second direction 412, with the second direction 412 being orthogonal to the first direction 410.

The first layer cutting element 402*a* can extend along the first direction 410 a distance 480 and along the second direction 412 a distance 482. In some examples, the distance 480 is less than the distance 482. In some examples, the first layer cutting element 402*a* has an elliptical geometric shape.

The second layer cutting element 402*b* can extend along the first direction 410 a distance 490 and along the second direction 412 a distance 492. In some examples, the second layer cutting element 402*b* has a circular geometric shape. In some examples, the distance 490 is greater than or equal to the distance 480. In some examples, the distance 482 is greater than or equal to the distance 492.

To that end, the second layer cutting element 402*b* can be underexposed relative to the first layer cutting element 402*a*, e.g., underexposed a distance $\delta 2$. That is, the second layer cutting element 4026 can be positioned relative to the first layer cutting element 402*a* such that the second layer cutting element 402*b* does not cut into the formations until a particular drilling depth is achieved, e.g., based on the distance $\delta 2$.

FIG. 4B illustrates the cutting elements 402 at a first level of wear. In some examples, the first level of wear can be substantially the same as the amount of underexposure of the second layer cutting element 4026 with respect to the first layer cutting element 402*a*, e.g., the distance $\delta 2$. As illustrated, the first layer cutting element 402, at the first level of wear, includes a first worn edge 440 that includes (non-efficient) cutting zones 442. Additionally, the second layer cutting element 402*b* includes a first cutting edge 444. In some examples, the first layer cutting element 402*a* can serve as the major cutter, while the second layer cutting element 4026 can begin to serve as an active cutter.

FIG. 4C illustrates the cutting elements 402 at a second level of wear. In some examples, the second level of wear is greater than the amount of underexposure of the second layer cutting element 402*b* with respect to the first layer cutting element 402*a*, e.g., the distance $\delta 2$. As illustrated, the first layer cutting element 402*a*, at the second level of wear, includes a second worn edge 460. Additionally, the second layer cutting element 402*b* includes a second cutting edge 462. In some examples, the second worn edge 460 of the first layer cutting element 402*a* and the second cutting edge 462 of the second layer cutting element 402*b* are at a substantially same radially position from a center of the drill bit 101. In some examples, the first layer cutting element 402*a* and the second layer cutting element 402*b* can both serve as major cutters.

Figure 5A:
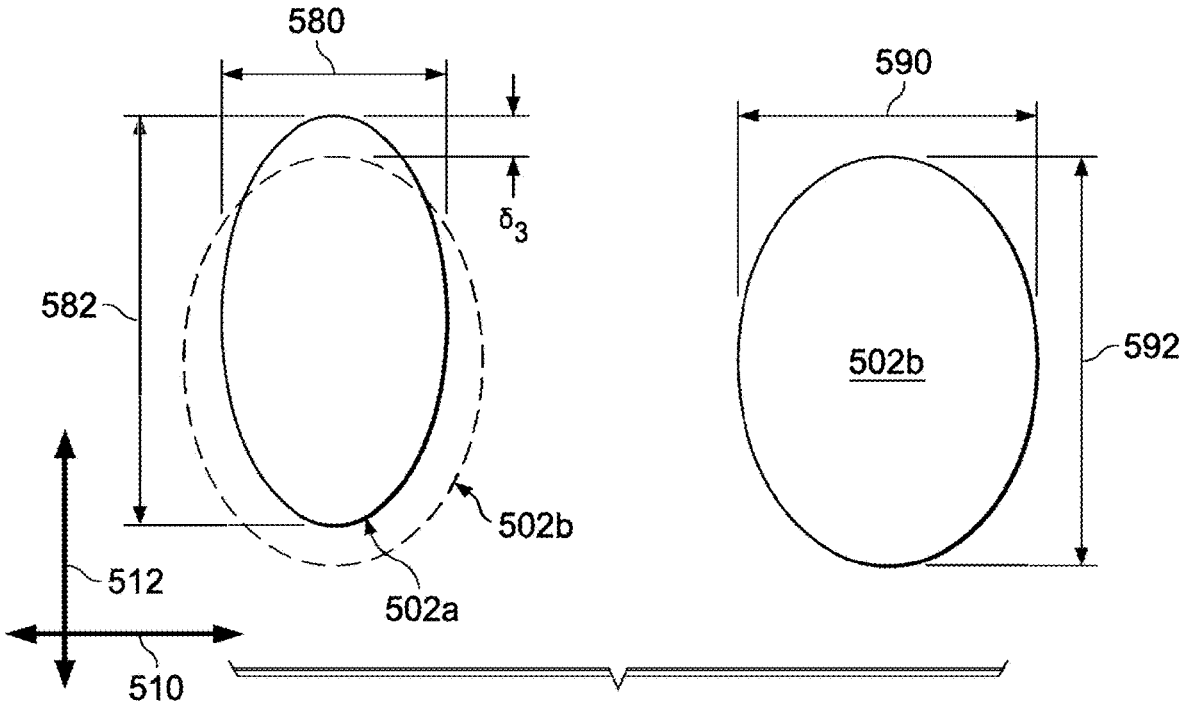
FIG. 5A is a perspective view of cutting elements of a rotary drill bit without wear.
Figure 5B:
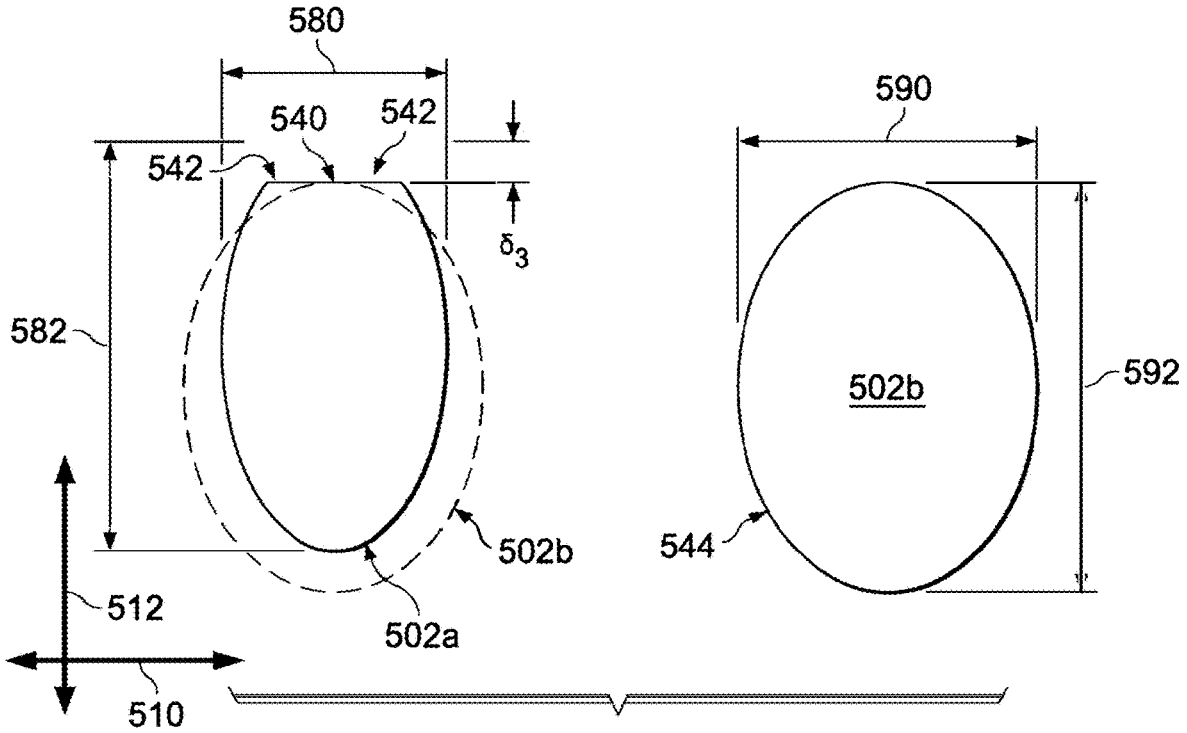
FIG. 5B is a perspective view of cutting elements of a rotary drill bit with little wear.
Figure 5C:
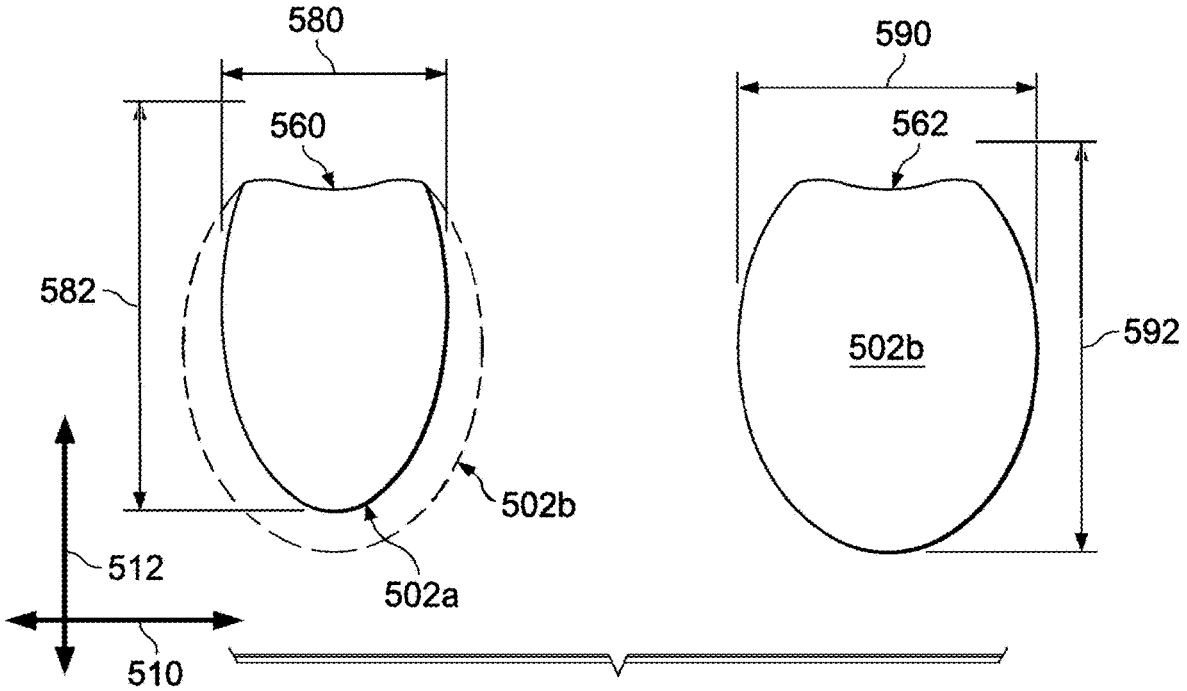
FIG. 5C is a perspective view of cutting elements of a rotary drill bit with substantial wear.

FIGS. 5A-5C illustrate a first layer cutting element 502*a* and a second layer cutting element 502*b* (collectively referred to as cutting elements 502). For simplicity of illustration, the first layer cutting element 502*a* is illustrated as overlaid with the second layer cutting element 5026, and the second layer cutting element 502*b* illustrated separately as well. The first layer cutting element 502*a* and the second layer cutting element 502*b* can be similar to the cutting elements 128 described above with respect to FIG. 1.

FIG. 5A illustrates the cutting elements 502 prior to wear on the cutting elements 502, and specifically, wear on the first layer cutting element 502*a*. The cutting elements 502 can extend along a first direction 510 and a second direction 512, with the second direction 512 being orthogonal to the first direction 510.

The first layer cutting element 502*a* can extend along the first direction 510 a distance 580 and along the second direction 512 a distance 582. In some examples, the distance 580 is less than the distance 582. In some examples, the first layer cutting element 502*a* has a first elliptical geometric shape.

The second layer cutting element 502*b* can extend along the first direction 510 a distance 590 and along the second direction 512 a distance 592. In some examples, the distance 590 is less than the distance 592. In some examples, the second layer cutting element 5026 has a second elliptical geometric shape that differs from the first elliptical geometric shape of the first layer cutting element 502*a*. In some examples, the distance 590 is greater than or equal to the distance 580. In some examples, the distance 582 is greater than or equal to the distance 592.

To that end, the second layer cutting element 502*b* can be underexposed relative to the first layer cutting element 502*a*, e.g., underexposed a distance δ3. That is, the second layer cutting element 5026 can be positioned relative to the first layer cutting element 502*a* such that the second layer cutting element 5026 does not cut into the formations until a particular drilling depth is achieved, e.g., based on the distance δ3.

FIG. 5B illustrates the cutting elements 502 at a first level of wear. In some examples, the first level of wear can be substantially the same as the amount of underexposure of the second layer cutting element 502*b* with respect to the first layer cutting element 502*a*, e.g., the distance δ3. As illustrated, the first layer cutting element 502, at the first level of wear, includes a first worn edge 540 that includes cutting zones 542. Additionally, the second layer cutting element 502*b* includes a first cutting edge 544. In some examples, the first layer cutting element 502*a* can serve as the major cutter, while the second layer cutting element 502*b* can begin to serve as an active cutter.

FIG. 5C illustrates the cutting elements 502 at a second level of wear. In some examples, the second level of wear is greater than the amount of underexposure of the second layer cutting element 502*b* with respect to the first layer cutting element 502*a*, e.g., the distance δ3. As illustrated, the first layer cutting element 502*a*, at the second level of wear, includes a second worn edge 560. Additionally, the second layer cutting element 502*b* includes a second cutting edge 562. In some examples, the second worn edge 560 of the first layer cutting element 502*a* and the second cutting edge 562 of the second layer cutting element 502*b* are at a substantially same radially position from a center of the drill bit 101. In some examples, the first layer cutting element 502*a* and the second layer cutting element 502*b* can both serve as major cutters.

Figure 6A:
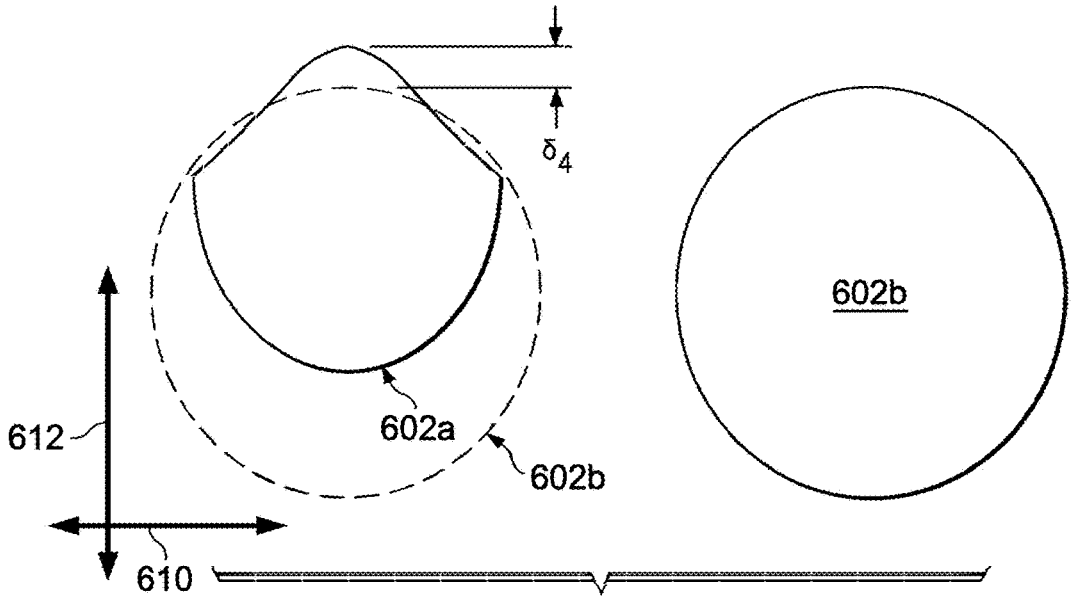
FIG. 6A is a perspective view of cutting elements of a rotary drill bit having a conical shape.
Figure 6B:
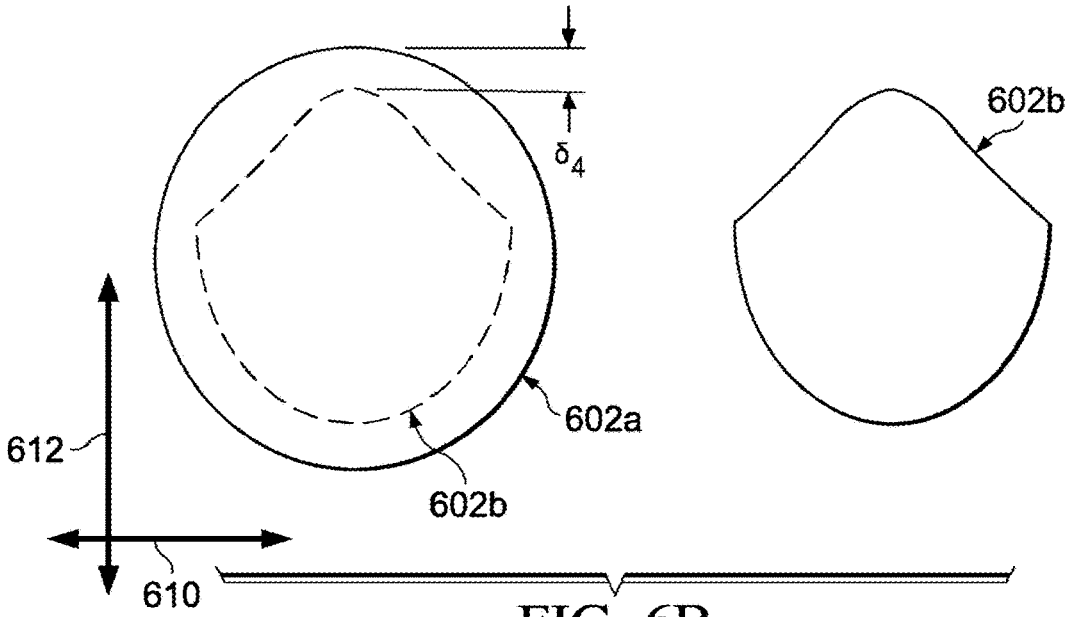
FIG. 6B is a perspective view of cutting elements of a rotary drill bit having a conical shape.

FIGS. 6A, 6B illustrate a first layer cutting element 602*a* and a second layer cutting element 602*b* (collectively referred to as cutting elements 602). For simplicity of illustration, the first layer cutting element 602*a* is illustrated as overlaid with the second layer cutting element 602*b*, and the second layer cutting element 602*b* illustrated separately as well. The first layer cutting element 602*a* and the second layer cutting element 602*b* can be similar to the cutting elements 128 described above with respect to FIG. 1.

FIG. 6A illustrates the cutting elements 602 prior to wear on the cutting elements 602, and specifically, wear on the first layer cutting element 602*a*. The cutting elements 602 can extend along a first direction 610 and a second direction 612, with the second direction 612 being orthogonal to the first direction 610.

The first layer cutting element 602*a* can include a conical shape along the second direction 612. The first layer cutting element 602*b* can include a circular geometric shape, or an elliptical geometric shape.

To that end, the second layer cutting element 602*b* can be underexposed relative to the first layer cutting element 602*a*, e.g., underexposed a distance δ4. That is, the second layer cutting element 602*b* can be positioned relative to the first layer cutting element 602*a* such that the second layer cutting element 602*b* does not cut into the formations until a particular drilling depth is achieved, e.g., based on the distance δ4.

Referring to FIG. 6B, in some examples, the second layer cutting element 602*b* can include a conical shape along the second direction 612; and the first layer cutting element 602*a* can include a circular geometric shape, or an elliptical geometric shape.

Figure 7:
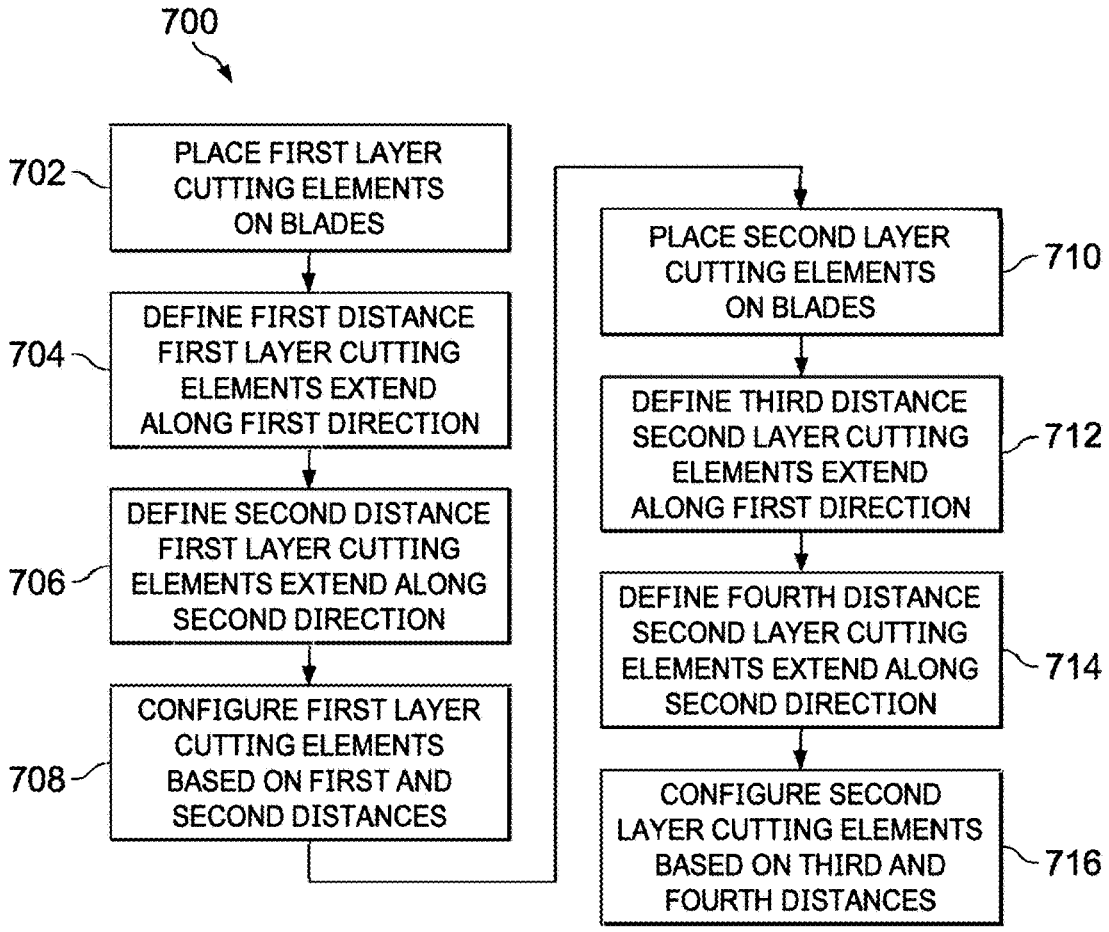
FIG. 7 is a flow chart of an example method for designing rotary drill bits with multi-layer cutting elements.

FIG. 7 illustrates a flow chart of an example method 700 for designing rotary drill bits with multi-layer cutting elements. The steps of method 700 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media. Collectively, the computer programs and models used to simulate and design drilling systems may be referred to as a "drilling engineering tool" or "engineering tool."

For illustrative purposes, method 700 is described with respect to drill bit 101 and cutting elements 302, 402, 502, 602.

Method 700 may start, and at step 702, the engineering tool may place first layer cutting elements (e.g., cutting elements 302*a*, 402*a*, 502*a*, and/or 602*a*) on blades 126 disposed on exterior portions of bit body 124. In some examples, the first layer cutting elements extend along a first direction and a second direction, with the first direction being orthogonal to the second direction. At step 704, the engineering tool defines a first distance that each of the first layer cutting elements (e.g., cutting elements 302*a*, 0402*a*, 502*a*, and/or 602*a*) extend along the first direction. At step 706, the engineering tool defines a second distance that each of the first layer cutting elements (e.g., cutting elements 302*a*, 402*a*, 502*a*, and/or 602*a*) extend along the second direction. In some examples, the first distance is less than the second distance. At step 708, the engineering tool configures the first layer cutting elements (e.g., cutting elements 302*a*, 402*a*, 502*a*, and/or 602*a*) based on the first distance and the second distance.

At step 710, the engineering tool places second layer cutting elements (e.g., cutting elements 302*b*, 402*b*, 502*b*, and/or 602*b*) on blades 126 disposed on exterior portions of bit body 124. In some examples, the second layer cutting elements extend along the first direction and the second direction, with the first direction being orthogonal to the second direction. At step 712, the engineering tool defines a third distance that each of the second layer cutting elements (e.g., cutting elements 302*b*, 402*b*, 502*b*, and/or 602*b*) extend along the first direction. At step 714, the engineering tool defines a fourth distance that each of the second layer cutting elements (e.g., cutting elements 302*b*, 402*b*, 502*b*, and/or 602*b*) extend along the second direction. In some examples, the third distance is greater than or equal to the first distance. At step 716, the engineering tool configures the second layer cutting elements (e.g., cutting elements 302*b*, 402*b*, 502*b*, and/or 602*b*) based on the third distance and the fourth distance.

FIGS. 8A-8I illustrate schematic drawings of bit faces of drill bit 801, which can be similar to drill bit 101. Specifically, FIGS. 8A-8I can illustrate placements for first layer cutting elements 828 (similar to any of first layer cutting elements 302*a*, 402*a*, 502*a*, 602*a*) and second layer cutting elements 838 (similar to any of second layer cutting elements 302*b*, 402*b*, 502*b*, 602*b*).

For purposes of this disclosure, blades 826, similar to blades 126, may be numbered 1-n based on the blade configuration. For example, FIGS. 8A-8I depict eight-bladed drill bits 801*a*-801*i* and blades 826 may be numbered 1-8. However, drill bit 801*a*-801*i* may include more or fewer blades than shown in FIGS. 8A-8I without departing from the scope of the present disclosure. For an eight-bladed drill bit, blades 1, 3, 5 and 7 may be primary blades, and 2, 4, 6 and 8 may be secondary blades.

In FIGS. 8A-8D, first layer cutting element 828*a* with cutlet point 830*a* may be located on blade 1 and first layer cutting element 828*c* may be located on blade 3. Cutting elements 828*a* and 828*c* may be single set.

Figure 8A:
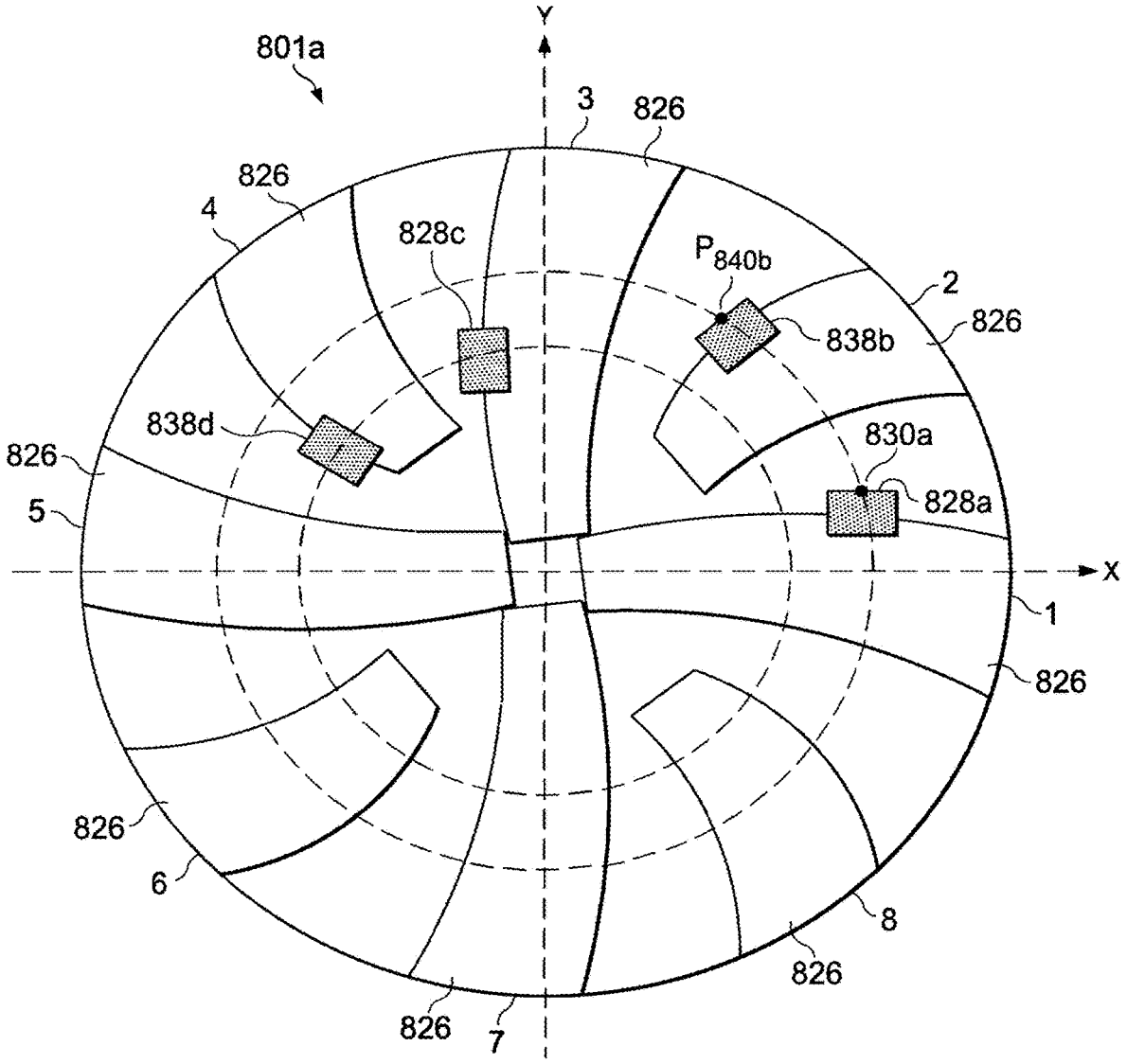
FIGS. 8A-8I illustrate schematic drawings of bit faces of a rotary drill bit.

FIG. 8A illustrates second layer cutting element 838*b* and control point P.sub.840*b* located on blade 2 of drill bit 801*a* such that second layer cutting element 8386 may be track set with first layer cutting element 828*a*. Second layer cutting element 838*d* may be located on blade 4 and may be track set with first layer cutting element 828*c*. Because second layer cutting elements are located on the blade rotationally in front of the corresponding first layer cutting element, drill bit 801*a* may be described as front track set.

Figure 8B:
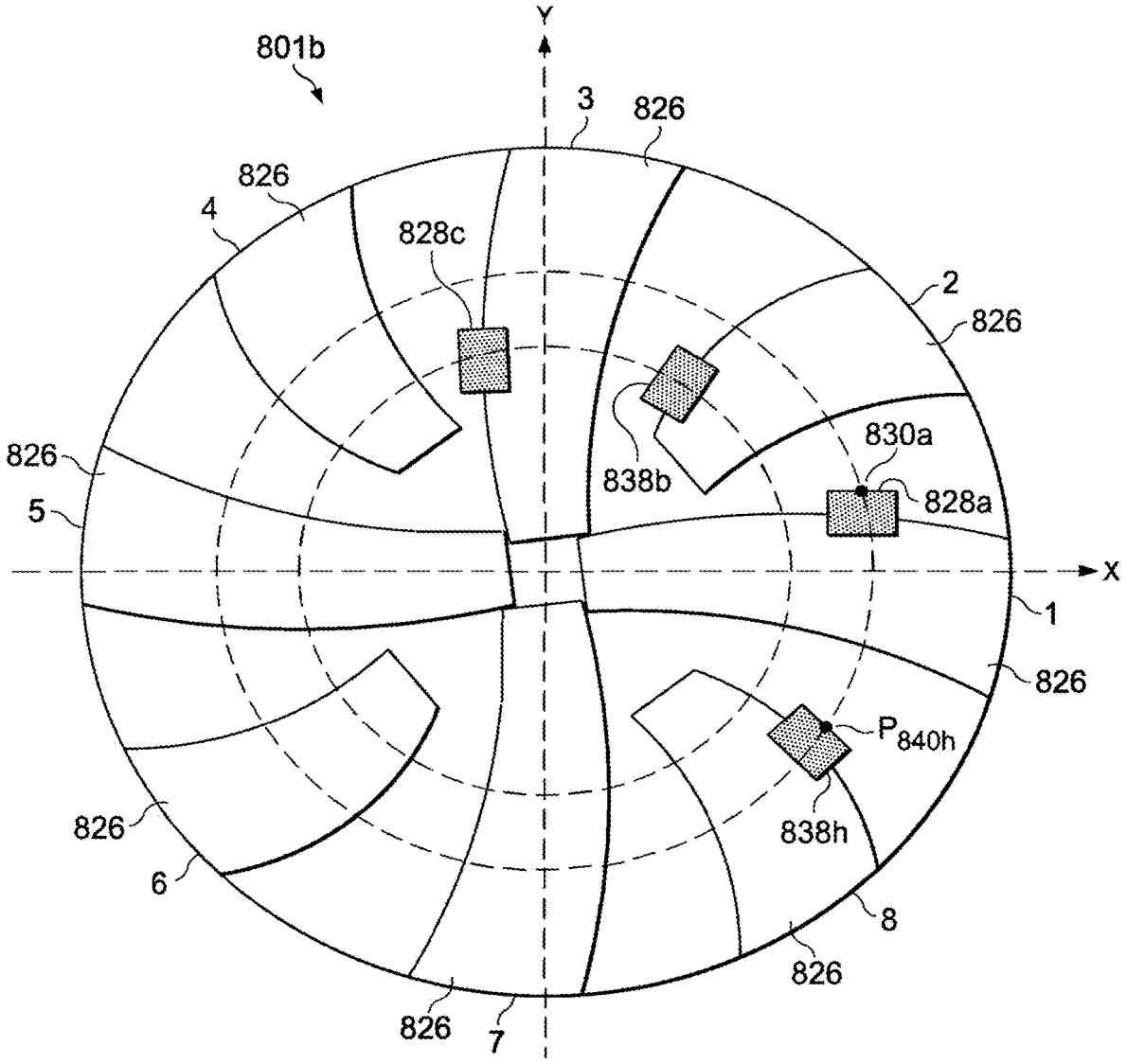

FIG. 8B illustrates second layer cutting element 838*h* and control point P.sub.840*h* located on blade 8 of drill bit 801*b* such that second layer cutting element 838*h* may be track set with first layer cutting element 828*a*. Second layer cutting element 838*b* may be located on blade 2 and may be track set with first layer cutting element 828*c*. Because second layer cutting elements are located on the blade rotationally behind the corresponding first layer cutting element, drill bit 801*b* may be described as behind track set.

Figure 8C:
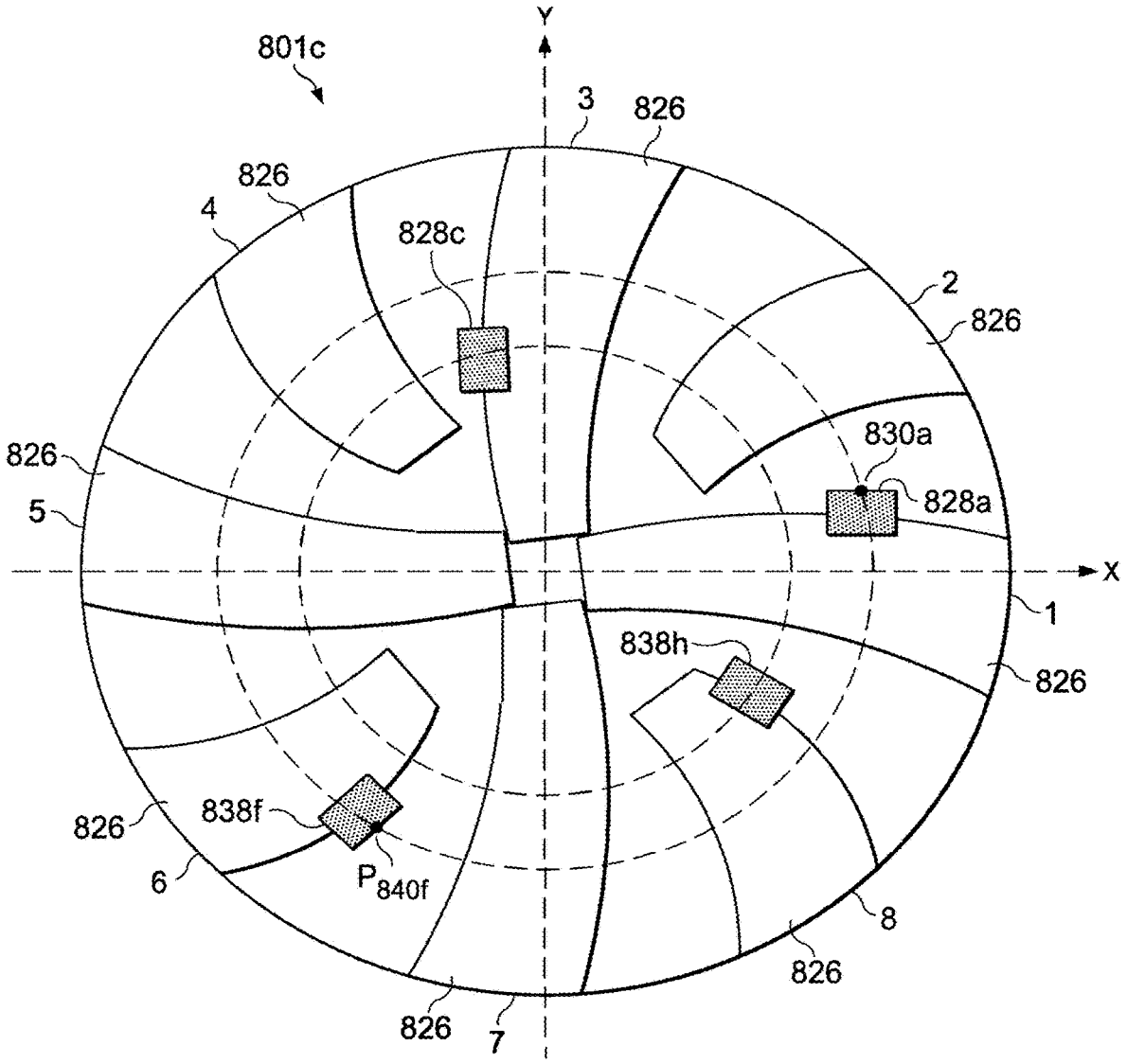

FIG. 8C illustrates second layer cutting element 838*f* and control point P.sub.840*f* located on blade 6 of drill bit 801*c* such that second layer cutting element 838*f* may be track set with first layer cutting element 828*a*. Second layer cutting element 838*h* may be located on blade 8 and may be track set with first layer cutting element 828*c*.

Figure 8D:
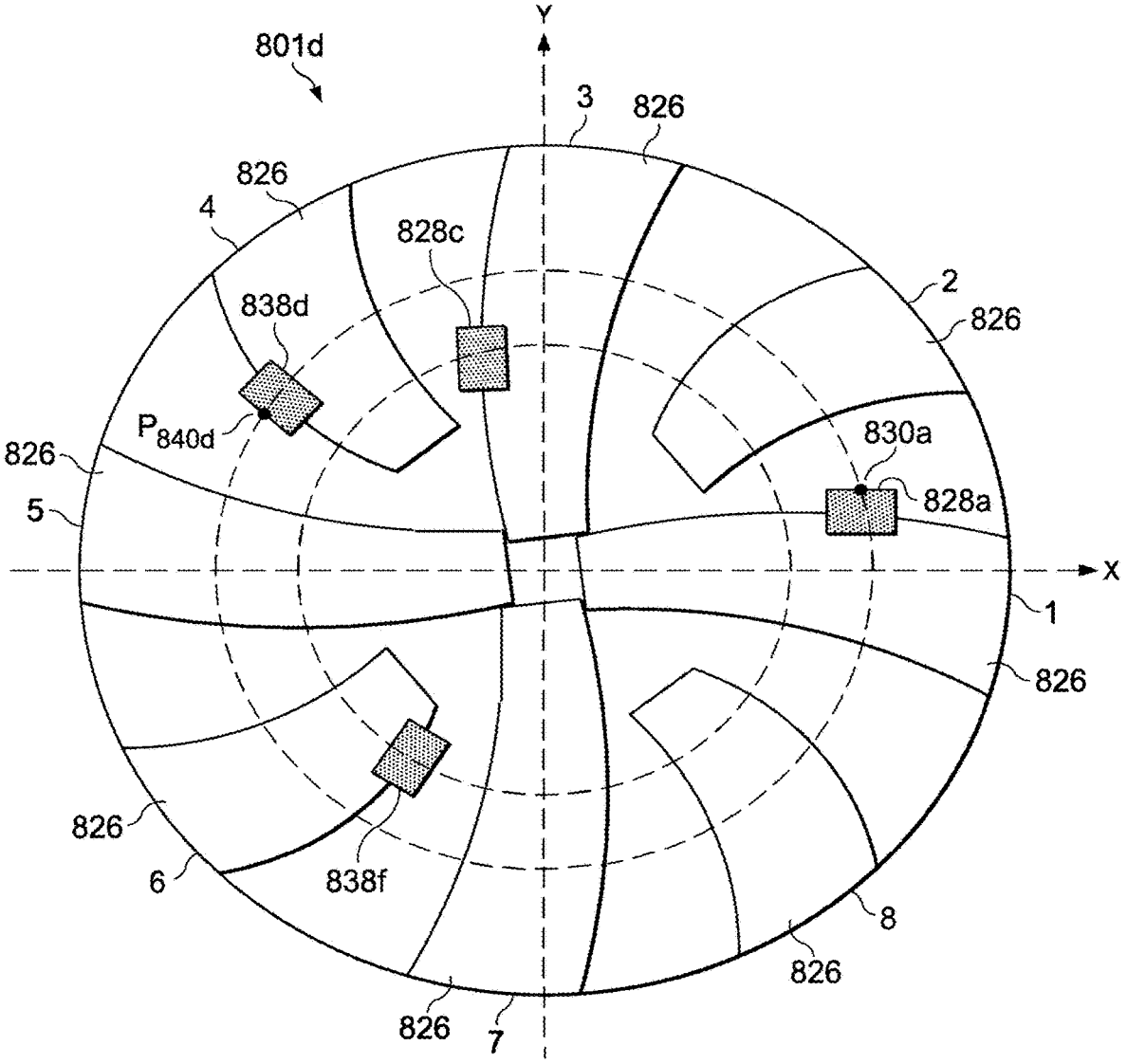

FIG. 8D illustrates second layer cutting element 838*d* and control point P.sub.840*d* located on blade 4 of drill bit 801*d* such that second layer cutting element 838*d* may be track set with first layer cutting element 828*a*. Second layer cutting element 838*f* may be located on blade 6 and may be track set with first layer cutting element 828*c*.

Figure 8E:
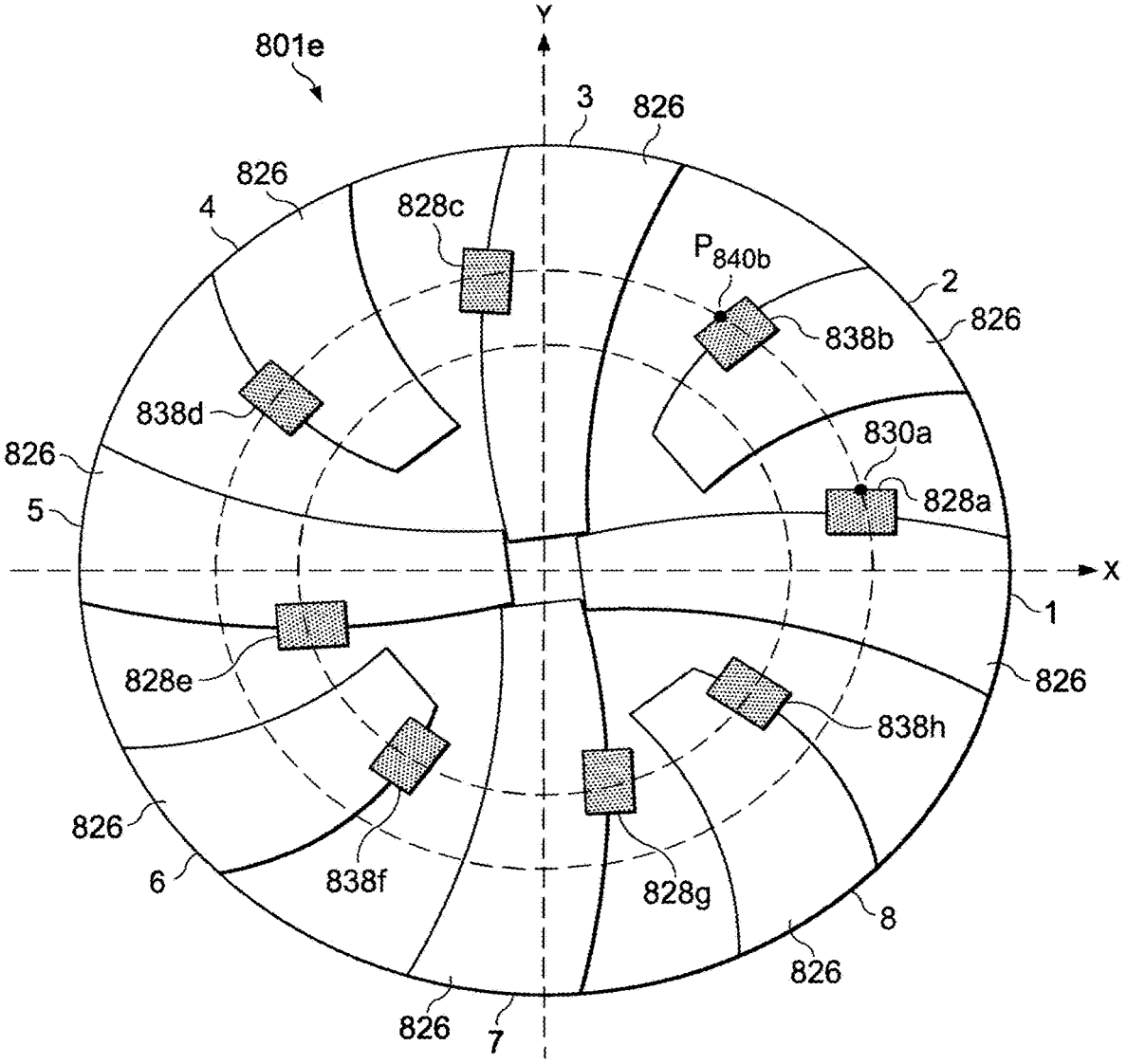

In FIG. 8E, first layer cutting element 828*a* with cutlet point 830*a* may be located on blade 1 of drill bit 801*e* and first layer cutting element 828*c* may be located on blade 3 such that cutting element 828*c* may be track set with first layer cutting element 828*a*. First layer cutting elements 828*e* and 828*g* located on blades 5 and 7, respectively, may also be track set. Second layer cutting elements 838*b* and 838*d*, located on blades 2 and 4, respectively, may be track set with first layer cutting elements 828*a* and 828*c*. Second layer cutting elements 838*f* and 838*h*, located on blades 6 and 8, respectively, may be track set with first layer cutting elements 828*e* and 828*g*. Second layer cutting element 838*b* may include control point P.sub.840*b*. As such, cutting elements on blades 1-4 may be track set (more specifically, front track set), and cutting elements on blades 5-8 may be track set.

Figure 8F:
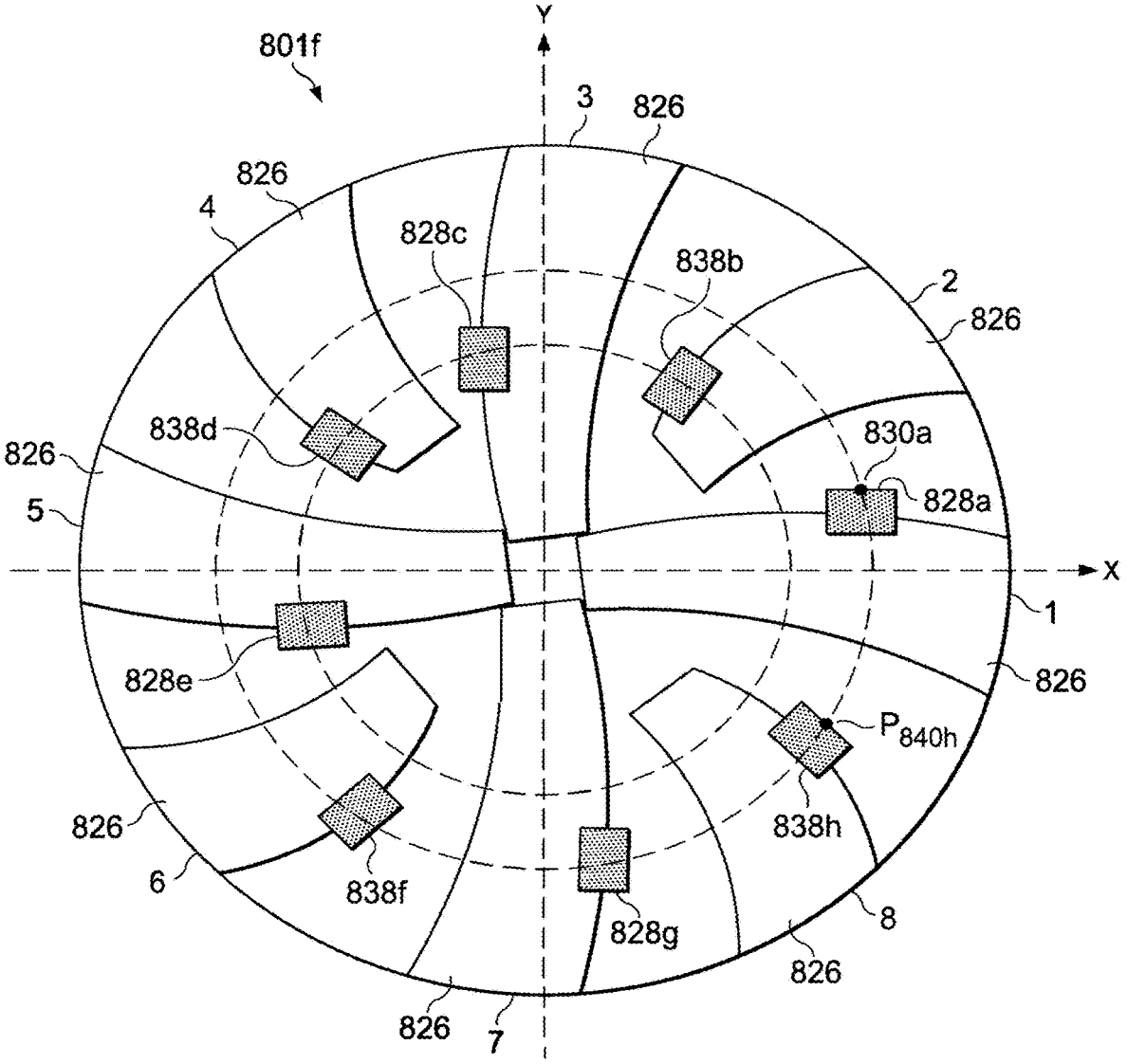

In FIG. 8F, first layer cutting element 828*a* with cutlet point 830*a* may be located on blade 1 of drill bit 801*f*. First layer cutting element 828*g* may be located on blade 7 and may be track set with first layer cutting element 828*a*. First layer cutting elements 828*c* and 828*e* located on blades 3 and 5, respectively, may also be track set. Second layer cutting elements 838*f* and 838*h*, located on blades 6 and 8, respectively, may be track set with first layer cutting elements 828*a* and 828*g*. Second layer cutting elements 838*b* and 838*d*, located on blades 2 and 4, respectively, may be track set with first layer cutting elements 828*c* and 828*e*. Second layer cutting element 838*h* may include control point P.sub.840*h*. As such, cutting elements on blades 2-5 may be track set (more specifically, back track set), and cutting elements on blades 1 and 6-8 may be track set.

Figure 8G:
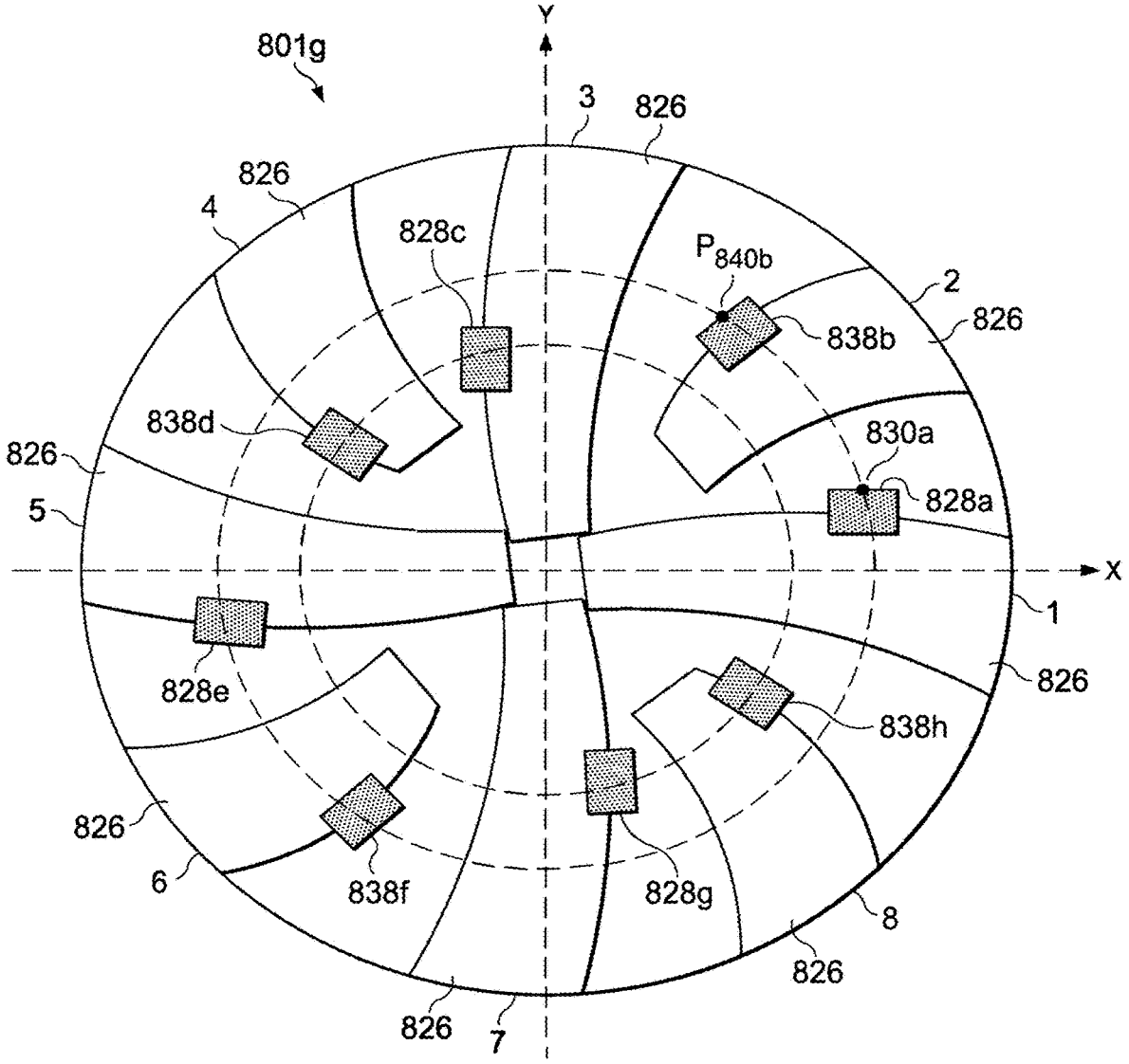

FIG. 8G illustrates first layer cutting element 828*a* with cutlet point 830*a* located on blade 1 of drill bit 801*g*. First layer cutting element 828*e* may be located on blade 5 and may be track set with first layer cutting element 828*a*. First layer cutting elements 828*c* and 828*g* located on blades 3 and 7, respectively, may also be track set. Second layer cutting elements 838*b* and 838*f*, located on blades 2 and 6, respectively, may be track set with first layer cutting elements 828*a* and 828*e*. Second layer cutting elements 838*d* and 838*h*, located on blades 4 and 8, respectively, may be track set with first layer cutting elements 828*c* and 828*g*. Second layer cutting element 838*b* may include control point P.sub.840*b*. As such, cutting elements on blades 1, 2, 5 and 6 may be track set, and cutting elements on blades 3, 4, 7, and 8 may be track set.

Figure 8H:
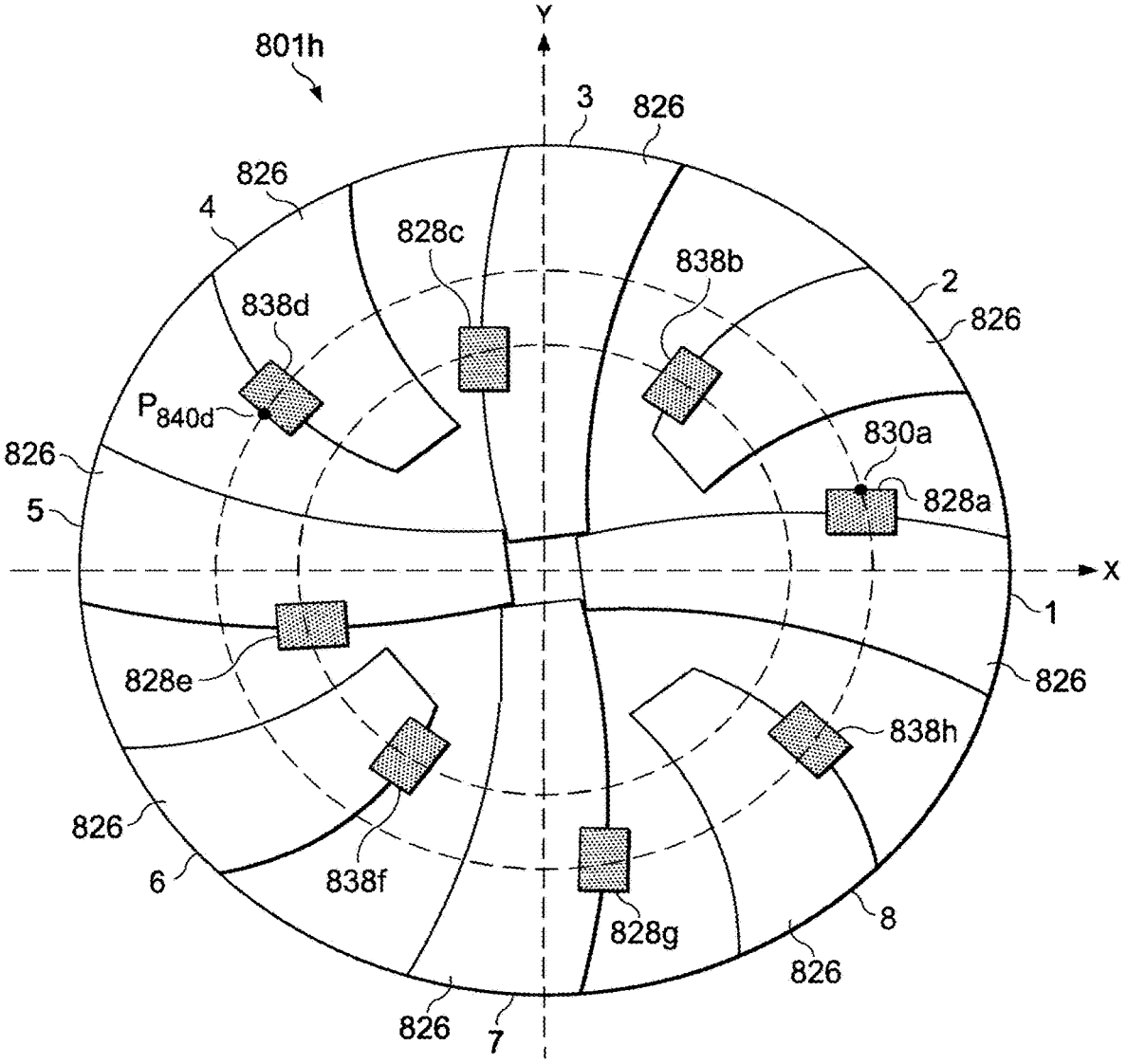

FIG. 8H illustrates first layer cutting element 828*a* with cutlet point 830*a* located on blade 1 of drill bit 801*h*. First layer cutting element 828*g* may be located on blade 7 and may be track set with first layer cutting element 828*a*. First layer cutting elements 828*c* and 828*e* located on blades 3 and 5, respectively, may also be track set. Second layer cutting elements 838*d* and 838*h*, located on blades 4 and 8, respectively, may be track set with first layer cutting elements 828*a* and 828*g*. Second layer cutting elements 838*b* and 838*f*, located on blades 2 and 6, respectively, may be track set with first layer cutting elements 828*c* and 828*e*. Second layer cutting element 838*d* may include control point P.sub.840*d*. As such, cutting elements on blades 1, 4, 7 and 8 may be track set, and cutting elements on blades 2, 3, 5, 6 may be track set.

Figure 8I:
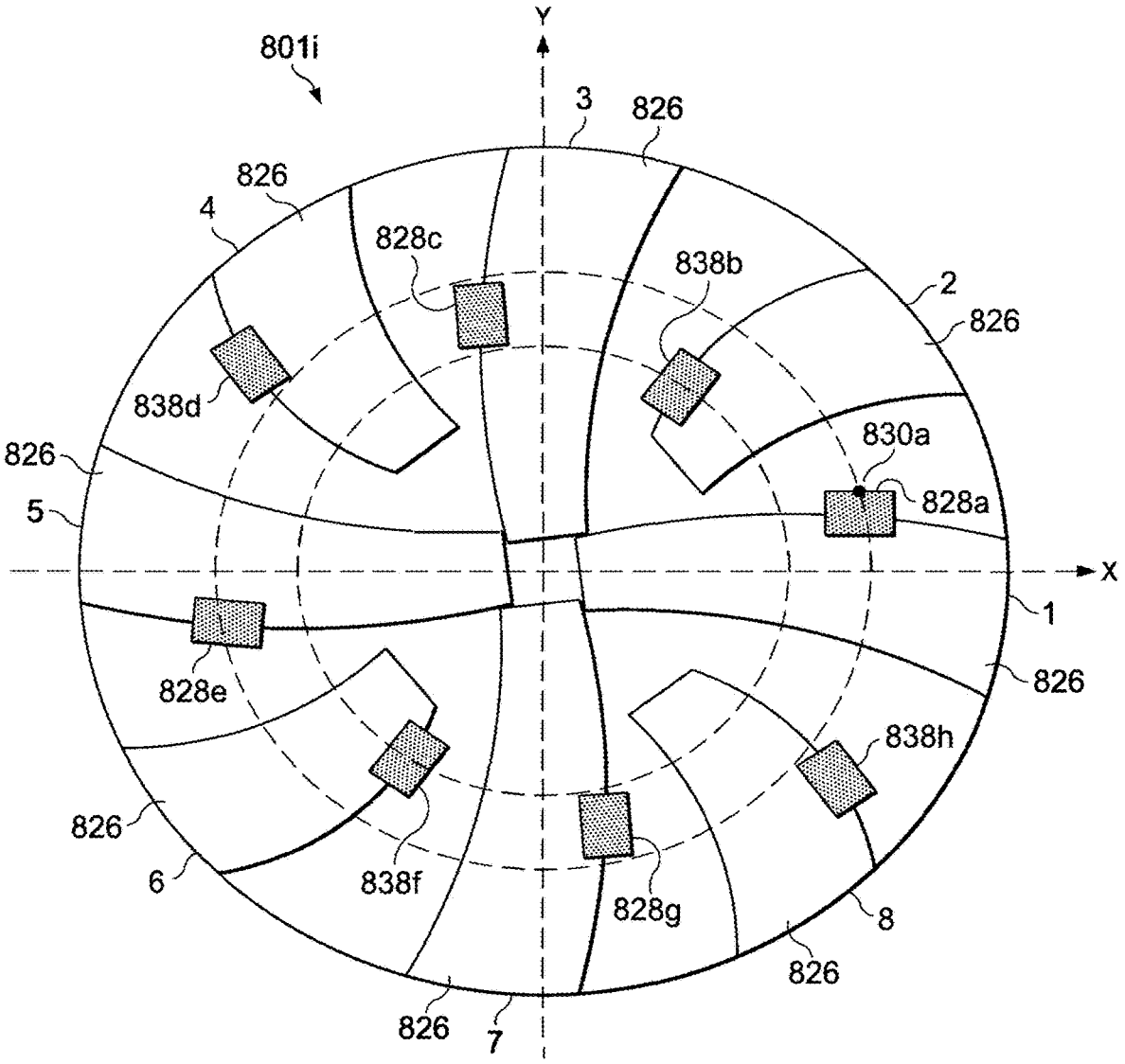

FIG. 8I illustrates first layer cutting element 828*a* with cutlet point 830*a* located on blade 1 of drill bit 801*i*. First layer cutting element 828*e* may be located on blade 5 and may be track set with first layer cutting element 828*a*. First layer cutting elements 828*c* and 828*g* located on blades 3 and 7, respectively, may also be track set. Second layer cutting elements 838*b* and 838*f*, located on blades 2 and 6, respectively, may be track set. Second layer cutting elements 838*d* and 838*h*, located on blades 4 and 8, respectively, may be track set.

Accordingly, FIGS. 9A-9F illustrate schematic drawing of bit faces of a drill bit with exemplary placements for first layer cutting elements 928 (similar to any of first layer cutting elements 302*a*, 402*a*, 502*a*, 602*a*) and back-up cutting elements 938 (similar to any of second layer cutting elements 302*b*, 402*b*, 502*b*, 602*b*), in accordance with some embodiments of the present disclosure. For purposes of this disclosure, blades 926 may also be numbered 1-n based on the blade configuration. For example, FIGS. 9A-9F depict seven-bladed drill bits 901*a*-901*f* and blades 926 may be numbered 1-7. However, drill bit 901*a*-901*f* may include more or fewer blades than shown in FIGS. 9A-9F without departing from the scope of the present disclosure.

Figure 9A:
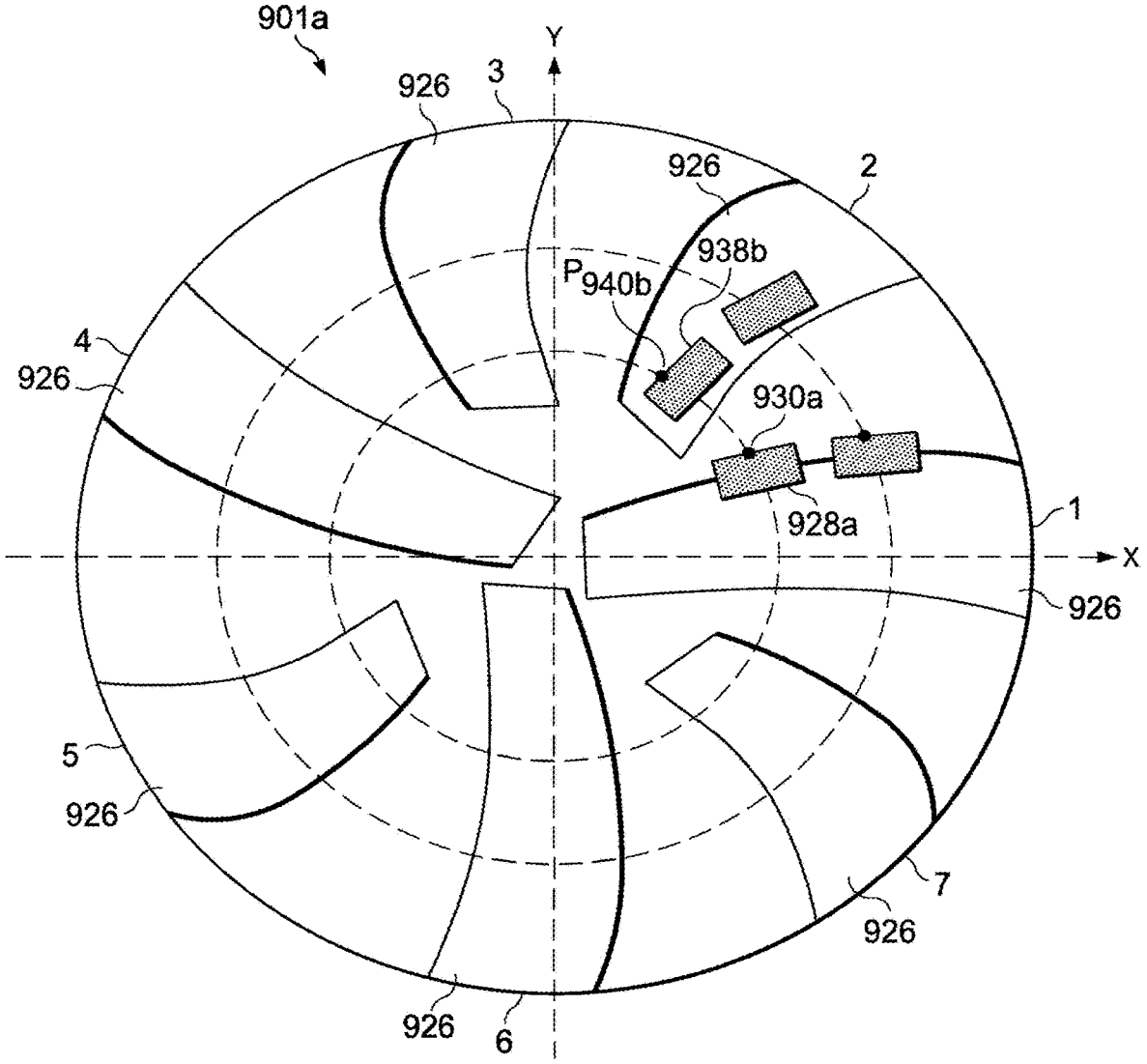
FIGS. 9A-9F illustrate schematic drawings of bit faces of a rotary drill bit with placements for back-up cutting elements.
Figure 9B:
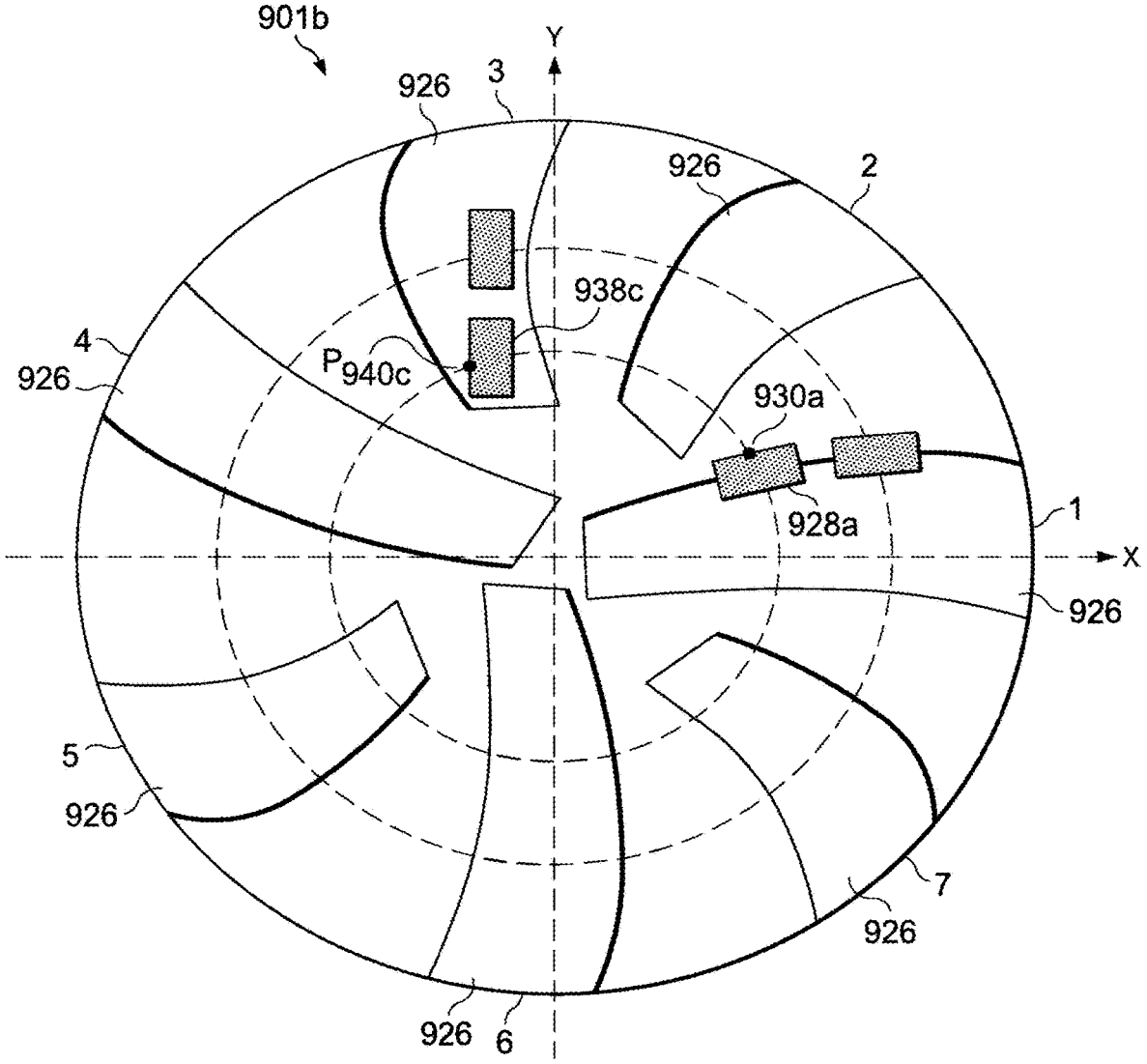
Figure 9C:
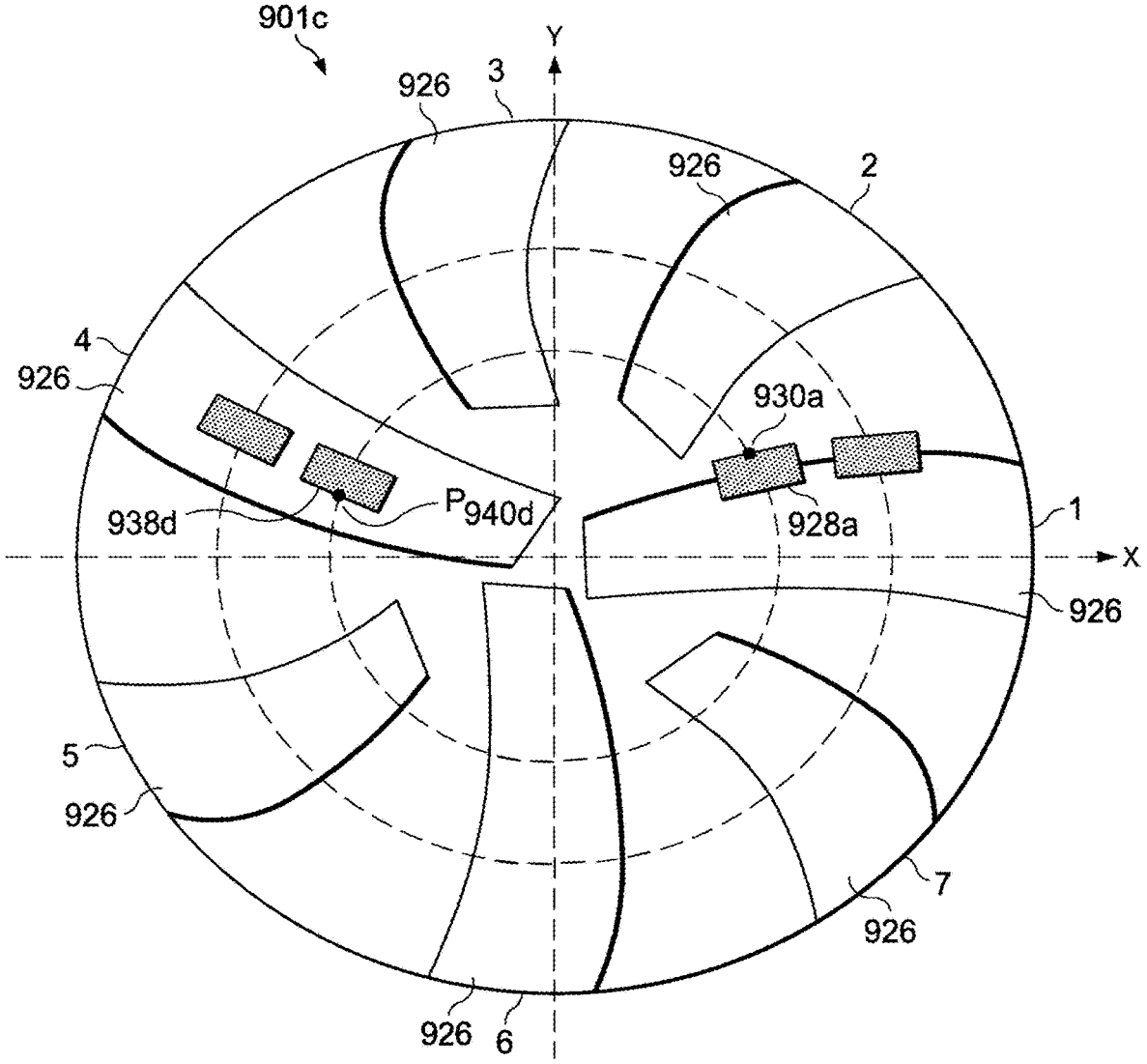
Figure 9D:
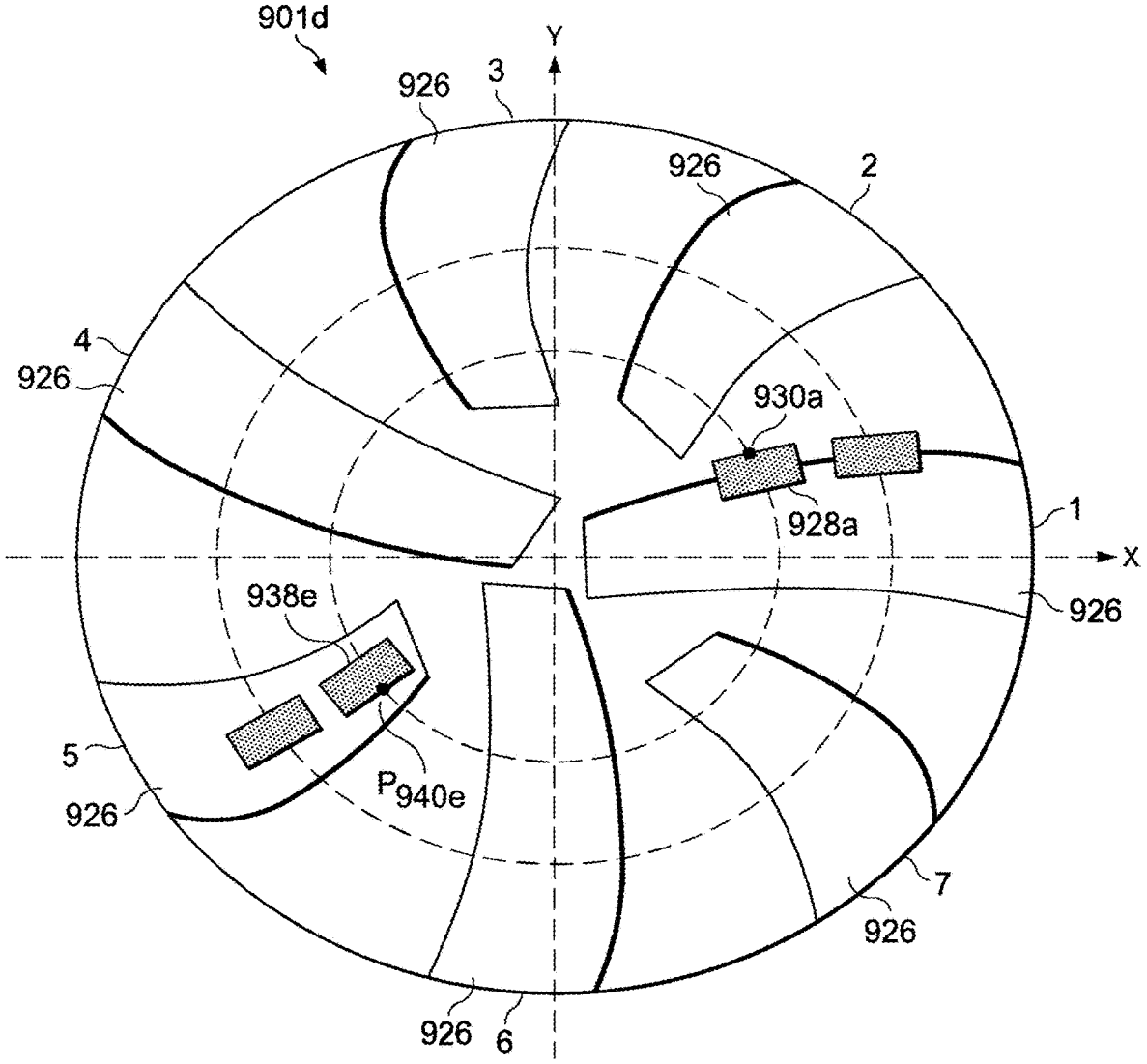
Figure 9E:
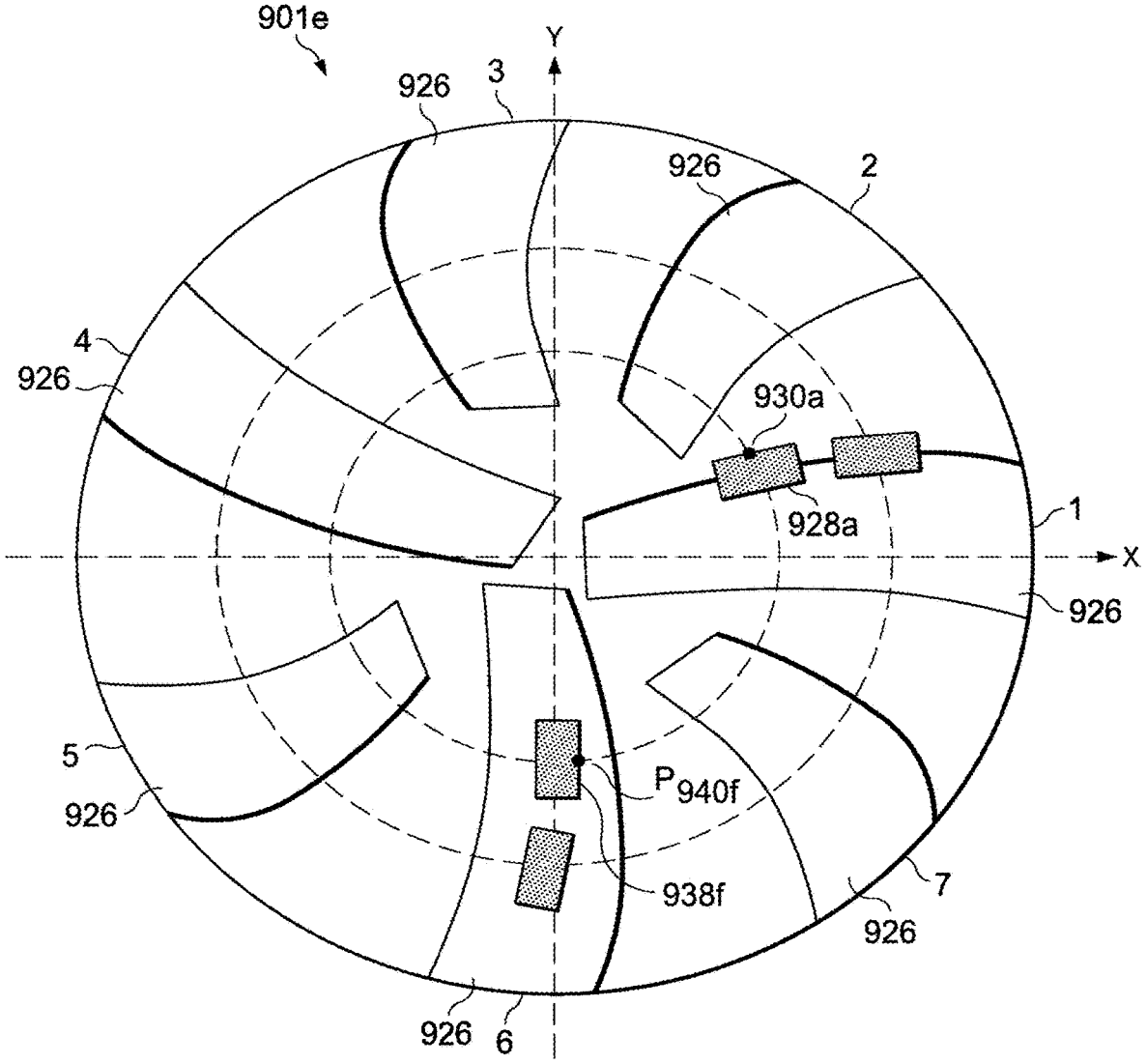
Figure 9F:
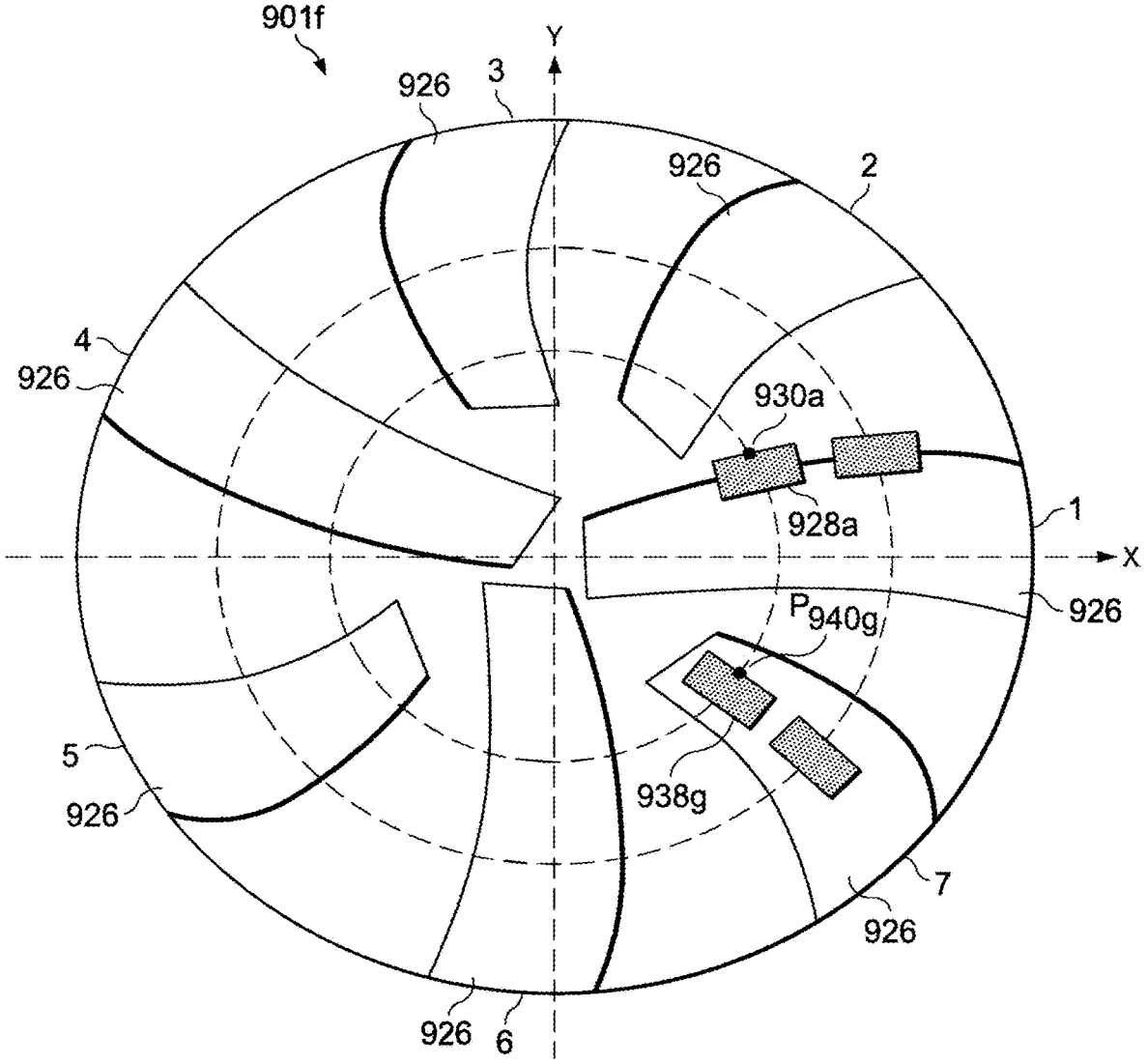

For a seven-bladed drill bit, there may be six possible blades 926 for placement of back-up cutting elements 938 in accordance with some embodiments of the present disclosure. In FIGS. 9A-9F, primary cutting elements 928*a* with cutlet points 930*a* may be located on blade 1. FIG. 9A illustrates back-up cutting elements 938*b* and control point P.sub.940*b* located on blade 2 of drill bit 901*a*. FIG. 9B illustrates back-up cutting elements 938*c* and control point P.sub.940*c* located on blade 3 of drill bit 901*b*. FIG. 9C illustrates back-up cutting elements 938*d* and control point P.sub.940*d* located on blade 4 of drill bit 901*c*. FIG. 9D illustrates back-up cutting elements 938*e* and control point P.sub.940*e* located on blade 5 of drill bit 901*d*. FIG. 9E illustrates back-up cutting elements 938*f* and control point P.sub.940*f* located on blade 6 of drill bit 901*e*. FIG. 9F illustrates back-up cutting elements 938*g* and control point P.sub.940*g* located on blade 7 of drill bit 901*f*.

Figure 10:
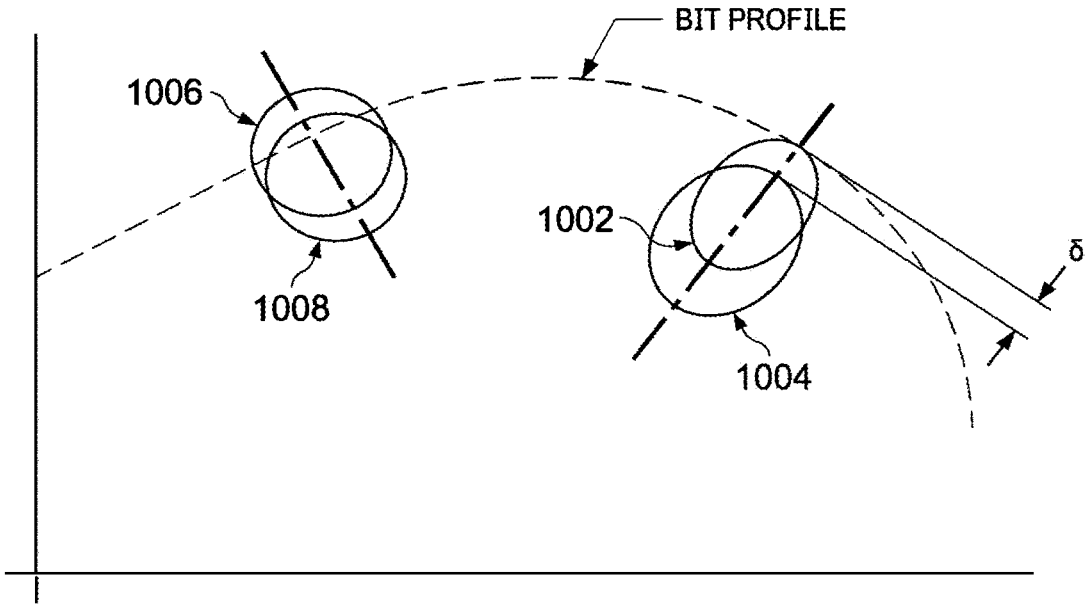
FIG. 10 illustrates a bit profile of a drill bit having track set cutting elements.

FIG. 10 illustrates a bit profile of a bit (e.g., drill bit 101) having track set cutting elements. For example, when the underexposure δ of the cutting element 1004 (similar to any of second layer cutting elements 302*b*, 402*b*, 502*b*, 602*b*) with respect to the cutting element 1002 (similar to any of first layer cutting elements 302*a*, 402*a*, 502*a*, 602*a*) is equal to zero, cutting elements 1002, 1004 have the same radial location along the bit profile. Similarly, cutting elements 1006, 1008 are also track set.

This disclosure includes a multi-layer downhole drilling tool designed for drilling a wellbore including a plurality of formations, include a bit body; a plurality of blades disposed on exterior portions of the bit body; a plurality of first layer cutting elements disposed on the exterior portions of the blades, each of the first layer cutting elements extending a first distance along a first direction and a second distance along a second direction, the first direction orthogonal to the second direction, wherein the first distance is less than the second distance; and a plurality of second layer cutting elements disposed on the exterior portions of the blades, at least one of the second layer cutting elements track set with one first layer cutting element and each of the second layer cutting elements extending a third distance along the first direction and a fourth distance along the second direction, wherein the third distance is greater than or equal to the first distance, wherein the at least one of the second layer cutting elements track set with the at least one first layer cutting element is larger than the first layer cutting element is arranged such that the second layer cutting element engages the formation when the track set first layer cutting element is sufficiently worn.

Some embodiments have one or more of the following additional elements, which may be used in any combination with one another or with other elements disclosed herein, unless clearly mutually exclusive: Element 1: wherein each of the plurality of second layer cutting elements is track set with one first layer cutting element. Element 2: wherein the at least one second layer cutting element is larger than the track set first layer cutting element. Element 3: wherein each second layer cutting element track set with a first layer cutting element is larger than the track set first layer cutting element. Element 4: wherein the at least one second layer cutting element has a rectangular geometric shape, with distal ends of the geometric shape along the second direction having an arc and the track set first layer cutting element has a rectangular geometric shape, with distal ends of the rectangular geometric shape along the second direction having an arc. Element 5: wherein each second layer cutting element track set with a first layer cutting element has a rectangular geometric shape, with distal ends of the geometric shape along the second direction having an arc and each track set first layer cutting element has a rectangular geometric shape, with distal ends of the rectangular geometric shape along the second direction having an arc. Element 6: wherein the at least one second layer cutting element has a circular geometric shape that is truncated along the first direction and the track set first layer cutting element has a circular geometric shape that is truncated along the first direction. Element 7: wherein each second layer cutting element track set with a first layer cutting element has a circular geometric shape that is truncated along the first direction and each track set first layer cutting element has a circular geometric shape that is truncated along the first direction. Element 8: wherein the at least one second layer cutting element has a circular geometric shape, and the track set first layer cutting element has an elliptical geometric shape. Element 9: wherein each second layer cutting element track set with a first layer cutting element has a circular geometric shape, and each track set first layer cutting element has an elliptical geometric shape. Element 10: wherein the at least one second layer cutting element has a first elliptical geometric shape, and the track set first layer cutting element has a second elliptical geometric shape. Element 11: wherein each second layer cutting element track set with a first layer cutting element has a first elliptical geometric shape, and each track set first layer cutting element has a second elliptical geometric shape. Element 12: wherein one of the at least one second layer cutting element or the track set first layer cutting element has a conical shape and the other has a circular geometric shape or an elliptical geometric shape. Element 13: where, for each second layer cutting element and its track set first layer cutting element, one of the second layer cutting element and the track set first layer cutting element has a conical shape and the other has a circular geometric shape or an elliptical geometric shape. Element 14: wherein the second distance is greater than or equal to the fourth distance.

This disclosure further includes a downhole drilling system, comprising a drill string and a drill bit coupled to the drill string. The drill bit comprises a bit body; primary blades disposed on an exterior portion of the bit body, each of the primary blades having a first nearest end to a rotational axis of the bit body at a first distance from the rotational axis; secondary blades disposed on the exterior portion of the bit body, each of the secondary blades having a second nearest end to the rotational axis at a second distance from the rotational axis, the second distance greater than the first distance, wherein at least some of the secondary blades are alternately disposed between some of the primary blades; two first layer cutting elements disposed on different ones of a first set of the primary blades, the two first layer cutting elements substantially diametrically opposed to each other along a circumference of a first track set radius of the bit body; and two second layer cutting elements disposed on different ones of a second set of the secondary blades, the two second layer cutting elements substantially diametrically opposed to each other along the circumference of the first track set radius of the bit body, the second layer cutting elements sized to provide a selected amount of underexposure greater than zero with respect to the first layer cutting elements.

Some embodiments have one or more of the following additional elements, which may be present in any combination with one another or with other elements disclosed herein, unless clearly mutually exclusive: Element 15: two first layer cutting elements disposed on different ones of a third set of the primary blades, and substantially diametrically opposed to each other around a circumference of a second track set radius of the bit body, the third set different from the first set; and two second layer cutting elements disposed on different ones of a fourth set of the secondary blades, and substantially diametrically opposed to each other around the circumference of the second track set radius of the bit body, the fourth set different from the second set.

Element 16: wherein the selected amount of underexposure of one of the second layer cutting elements is different from another one of the second layer cutting elements. Element 17: wherein at least one of the first layer cutting elements on the first track set radius has a smaller cutting surface than a cutting surface of the second layer cutting elements on the first track radius. Element 18: wherein at least one of the first layer cutting elements on the first track set radius has a larger cutting surface than a cutting surface of the second layer cutting elements on the first track radius. Element 19: wherein some of the first layer cutting elements and the second layer cutting elements have a rectangular geometric shape with distal ends forming an arc. Element 20: wherein some of the first and second layer cutting elements have a truncated, circular geometric shape. Element 21: wherein some of the first layer cutting elements and the second layer cutting elements have an elliptical geometric shape. Element 22: wherein some of the first layer cutting elements have an elliptical geometric shape, and where some of the second layer cutting elements have a circular geometric shape. Element 23: wherein some of the first layer cutting elements or the second layer cutting elements have a conical geometric shape. Element 24: wherein the amount of underexposure is selected so that at least one of the second layer cutting element does not cut into a formation during downhole drilling operations until a particular drilling depth is achieved. Element 25: wherein the amount of underexposure is selected so that at least one of the second layer cutting elements does not cut into a formation during downhole drilling operations until a sufficient level of wear is experienced by the first layer cutting elements. Element 26: comprising one of a Polycrystalline Diamond Compact (PDC) bit, a drag bit, a matrix bit, or a steel body bit. Element 27: wherein some of the first layer cutting elements or some of the second layer cutting elements have a truncated, circular geometric shape; an elliptical geometric shape; a circular geometric shape; a conical geometric shape; or a rectangular geometric shape with distal ends forming an arc. Element 28: wherein the amount of underexposure is selected so that at least one of the second layer cutting elements does not cut into a formation during downhole drilling operations until a particular drilling depth is achieved, or until a sufficient level of wear is experienced by the first layer cutting elements.

Although the present disclosure and its advantages have been described in detail, it should be understood that various changes, substitutions and alternations can be made herein without departing from the scope of the disclosure as defined by the following claims. For example, although the present disclosure describes the configurations of blades and cutting elements with respect to drill bits, the same principles may be used with any suitable drilling tool according to the present disclosure. It is intended that the present disclosure encompasses such changes and modifications as fall within the scope of the appended claims.

The invention claimed is:

1. A downhole drill bit, comprising:

a bit body;

primary blades disposed on an exterior portion of the bit body, each of the primary blades having a first nearest end to a rotational axis of the bit body at a first distance from the rotational axis;

secondary blades disposed on the exterior portion of the bit body, each of the secondary blades having a second nearest end to the rotational axis at a second distance from the rotational axis, the second distance greater than the first distance, wherein at least some of the secondary blades are alternately disposed between some of the primary blades;

two first layer cutting elements disposed on different ones of a first set of the primary blades, the two first layer cutting elements substantially diametrically opposed to each other along a circumference of a first track set radius of the bit body; and two second layer cutting elements disposed on different ones of a second set of the secondary blades, the two second layer cutting elements substantially diametrically opposed to each other along the circumference of the first track set radius of the bit body, the second layer cutting elements sized to provide a selected amount of underexposure greater than zero with respect to the first layer cutting elements, wherein an outer edge of a cutting surface of at least one of the first layer cutting elements or the second layer cutting elements has a generally rectangular geometric shape with a distal end terminating in an arc.

2. The downhole drill bit of claim 1, further comprising:

two first layer cutting elements disposed on different ones of a third set of the primary blades, and substantially diametrically opposed to each other around a circumference of a second track set radius of the bit body, the third set different from the first set; and two second layer cutting elements disposed on different ones of a fourth set of the secondary blades, and substantially diametrically opposed to each other around the circumference of the second track set radius of the bit body, the fourth set different from the second set.

3. The downhole drill bit of claim 1, wherein the selected amount of underexposure of one of the second layer cutting elements is different from another one of the second layer cutting elements.

4. The downhole drill bit of claim 1, wherein at least one of the first layer cutting elements on the first track set radius has a smaller cutting surface than a cutting surface of the second layer cutting elements on the first track set radius.

5. The downhole drill bit of claim 1, wherein at least one of the first layer cutting elements on the first track set radius has a larger cutting surface than a cutting surface of the second layer cutting elements on the first track set radius.

6. The downhole drill bit of claim 1, wherein some of the first and second layer cutting elements have a truncated, circular geometric shape.

7. The downhole drill bit of claim 1, wherein some of the first layer cutting elements and the second layer cutting elements have an elliptical geometric shape.

8. The downhole drill bit of claim 1, wherein some of the first layer cutting elements have an elliptical geometric shape, and where some of the second layer cutting elements have a circular geometric shape.

9. The downhole drill bit of claim 1, wherein some of the first layer cutting elements or the second layer cutting elements have a conical geometric shape.

10. The downhole drill bit of claim 1, wherein the amount of underexposure is selected so that at least one of the second layer cutting elements does not cut into a formation during downhole drilling operations until a particular drilling depth is achieved, based on cutting element configuration considerations including blade placement of the second layer cutting elements with respect to the first layer cutting elements, and/or characteristics of the formation to be drilled.

11. The downhole drill bit of claim 1, wherein the amount of underexposure is selected so that at least one of the second layer cutting elements does not cut into a formation during downhole drilling operations until a sufficient level of wear is experienced by the first layer cutting elements to expose the second layer cutting elements.

12. The downhole drill bit of claim 1, comprising one of a Polycrystalline Diamond Compact (PDC) bit, a drag bit, a matrix bit, or a steel body bit.

13. A downhole drilling system, comprising:

a drill string; and a drill bit coupled to the drill string, the drill bit comprising:

a bit body;

primary blades disposed on an exterior portion of the bit body, each of the primary blades having a first nearest end to a rotational axis of the bit body at a first distance from the rotational axis;

secondary blades disposed on the exterior portion of the bit body, each of the secondary blades having a second nearest end to the rotational axis at a second distance from the rotational axis, the second distance greater than the first distance, wherein at least some of the secondary blades are alternately disposed between some of the primary blades;

two first layer cutting elements disposed on different ones of a first set of the primary blades, the two first layer cutting elements substantially diametrically opposed to each other along a circumference of a first track set radius of the bit body; and two second layer cutting elements disposed on different ones of a second set of the secondary blades, the two second layer cutting elements substantially diametrically opposed to each other along the circumference of the first track set radius of the bit body, the second layer cutting elements sized to provide a selected amount of underexposure greater than zero with respect to the first layer cutting elements, wherein an outer edge of a cutting surface of at least one of the first layer cutting elements or the second layer cutting elements has a generally rectangular geometric shape with a distal end terminating in an arc.

14. The downhole drilling system of claim 13, further comprising:

two first layer cutting elements disposed on different ones of a third set of the primary blades, and substantially diametrically opposed to each other around a circumference of a second track set radius of the bit body, the third set different from the first set; and two second layer cutting elements disposed on different ones of a fourth set of the secondary blades, and substantially diametrically opposed to each other around the circumference of the second track set radius of the bit body, the fourth set different from the second set.

15. The downhole drilling system of claim 13, wherein the selected amount of underexposure of one of the second layer cutting elements is different from another one of the second layer cutting elements.

16. The downhole drilling system of claim 13, wherein at least one of the first layer cutting elements on the first track set radius has a smaller cutting surface than a cutting surface of the second layer cutting elements on the first track set radius.

17. The downhole drilling system of claim 13, wherein at least one of the first layer cutting elements on the first track set radius has a larger cutting surface than a cutting surface of the second layer cutting elements on the first track set radius.

18. The downhole drilling system of claim 13, wherein some of the first layer cutting elements or some of the second layer cutting elements have: a truncated, circular geometric shape; an elliptical geometric shape; a circular geometric shape; or a conical geometric shape.

19. The downhole drilling system of claim 13, wherein the amount of underexposure is selected so that at least one of the second layer cutting elements does not cut into a formation during downhole drilling operations until a particular drilling depth is achieved, based on cutting element configuration considerations including blade placement of the second layer cutting elements with respect to the first layer cutting elements, and/or characteristics of the formation to be drilled, or until a sufficient level of wear is experienced by the first layer cutting elements to expose the second layer cutting elements.

* * * * *